US012195260B2

(12) United States Patent
Kang et al.

(10) Patent No.: US 12,195,260 B2
(45) Date of Patent: Jan. 14, 2025

(54) PANEL PACKAGING TRAY

(71) Applicant: Samsung Display Co., Ltd., Yongin-si (KR)

(72) Inventors: Taegil Kang, Hwaseong-si (KR); Jeong-Min Seo, Yongin-si (KR); Byung Jin Kim, Cheonan-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 60 days.

(21) Appl. No.: 17/986,228

(22) Filed: Nov. 14, 2022

(65) Prior Publication Data

US 2023/0227231 A1 Jul. 20, 2023

(30) Foreign Application Priority Data

Jan. 17, 2022 (KR) ..... 10-2022-0006387

(51) Int. Cl.
*B65D 81/05* (2006.01)
*B65D 81/02* (2006.01)
*B65D 85/30* (2006.01)

(52) U.S. Cl.
CPC ..... *B65D 81/022* (2013.01); *B65D 85/30* (2013.01); *B65D 2581/051* (2013.01); *B65D 2585/6837* (2013.01)

(58) Field of Classification Search
CPC ..... B65D 81/022; B65D 85/30; B65D 2581/051; B65D 2585/6837; B65D 81/05
USPC ..... 206/565
See application file for complete search history.

(56) References Cited

U.S. PATENT DOCUMENTS 3,339,722 A * 9/1967 Van Antwerpen ..... B65D 85/48 220/920
10,392,176 B1 8/2019 Hu
2020/0198867 A1* 6/2020 Nakamichi ..... H01L 21/67369

FOREIGN PATENT DOCUMENTS

CN 200974674 Y 11/2007
DE 10025171 A1 11/2001
KR 1020100034265 A 4/2010
KR 101107749 B1 1/2012
(Continued)

OTHER PUBLICATIONS

European Search Report dated Sep. 20, 2023, issued in corresponding European Patent Application No. EP23150841.
(Continued)

*Primary Examiner* — King M Chu
(74) *Attorney, Agent, or Firm* — CANTOR COLBURN LLP

(57) ABSTRACT

A panel packaging tray includes a packaging case including a sidewall which defines a receiving section in which a display panel is accommodated and a plurality of supports disposed on an inside surface of the sidewall, where the supports guide a position of the display panel on a plane crossing the inside surface. A supporter of the supports includes a fixing unit coupled with the sidewall and a buffer unit disposed between the fixing unit and the display panel. The buffer unit includes a straight portion, a corner portion, and a curved portion located between the straight portion and the corner portion, based on a direction parallel to the plane. A curvature of a curved surface included in the curved portion is determined by a maximum tilt angle by which the display panel is allowed to be tilted in a state of being accommodated in the receiving section.

23 Claims, 17 Drawing Sheets

(56) References Cited

FOREIGN PATENT DOCUMENTS

| | | | |
|---|---|---|---|
| KR | 200458066 | Y1 | 1/2012 |
| KR | 20130101837 | A | 9/2013 |
| KR | 101633117 | B1 | 6/2016 |
| WO | 2020129805 | A1 | 6/2020 |

OTHER PUBLICATIONS

Partial European Search Report dated Jun. 2, 2023, issued in corresponding European Patent Application No. EP23150841.

* cited by examiner

PANEL PACKAGING TRAY

This application claims priority to Korean Patent Application No. 10-2022-0006387, filed on Jan. 17, 2022, and all the benefits accruing therefrom under 35 U.S.C. § 119, the content of which in its entirety is herein incorporated by reference.

BACKGROUND

1. Field

Embodiments of the disclosure described herein relate to a panel packaging tray, and more particularly, relate to a panel packaging tray for accommodating a display panel.

2. Description of the Related Art

Various electronic devices, such as a television, a mobile phone, a tablet computer, a navigation unit, a game machine, and the like, include a display panel for displaying an image.

In general, in a manufacturing process and storage for the display panel, the display panel is stored in a state of being accommodated in a packaging tray for protection from an external impact and safe transfer and delivery.

SUMMARY

Embodiments of the disclosure provide a panel packaging tray for preventing damage to a display panel due to an external impact by guiding the position of the display panel.

According to an embodiment, a panel packaging tray includes a packaging case including a sidewall which defines a receiving section in which a display panel is accommodated and a plurality of supports disposed on an inside surface of the sidewall, where the supports guide a position of the display panel on a plane defined to cross the inside surface. In such an embodiment, a supporter of the supports includes a fixing unit coupled with the sidewall and a buffer unit disposed between the fixing unit and the display panel. In such an embodiment, the buffer unit includes a straight portion, a corner portion, and a curved portion located between the straight portion and the corner portion, based on a direction parallel to the plane. In such an embodiment, a curvature of a curved surface included in the curved portion is determined by a maximum tilt angle by which the display panel is allowed to be tilted in a state of being accommodated in the receiving section.

In an embodiment of the disclosure, the buffer unit may include a first point at which the straight portion and the curved portion meet each other, a second point at which the curved portion and the corner portion meet each other, and a third point at which the corner portion and the fixing unit meet each other. In such an embodiment, a direction parallel to the straight portion may be referred to as a first reference direction, and a direction parallel to a straight line defined to pass through the first point and the second point may be referred to as a second reference direction. In such an embodiment, the first reference direction and the second reference direction may cross each other, and an acute angle between the first reference direction and the second reference direction may be a first angle.

In an embodiment of the disclosure, the display panel may include a plurality of side surfaces. In such an embodiment, a side surface when the display panel makes contact with the curved portion in the state of being accommodated in the receiving section, among the plurality of side surfaces, may be referred to as an adjacent surface. In such an embodiment, an acute angle between the first reference direction and a direction parallel to the adjacent surface may be referred to as a tilt angle, and the maximum tilt angle may be the largest value of the tilt angle.

In an embodiment of the disclosure, the first angle may be greater than or equal to the maximum tilt angle.

In an embodiment of the disclosure, the first angle may be smaller than twice the maximum tilt angle.

In an embodiment of the disclosure, when a direction parallel to a straight line defined to pass through the second point and the third point is referred to as a third reference direction, the first angle may differ from a second angle which is an acute angle between the second reference direction and the third reference direction.

In an embodiment of the disclosure, the first angle may be smaller than the second angle.

In an embodiment of the disclosure, the curved portion may include a first curved surface having a first curvature based on the plane, and the corner portion may include a second curved surface having a second curvature based on the plane. In such an embodiment, the first curvature and the second curvature may differ from each other.

In an embodiment of the disclosure, the first curvature may be smaller than the second curvature.

In an embodiment of the disclosure, a plurality of grooves may be defined on the curved portion.

In an embodiment of the disclosure, the sidewall may include a first corner area in which a first inside surface and a second inside surface meet each other, a second corner area in which the second inside surface and a third inside surface meet each other, a third corner area in which the third inside surface and a fourth inside surface meet each other, and a fourth corner area in which the first inside surface and the fourth inside surface meet each other.

In an embodiment of the disclosure, the supports may include, on the plane, a first support which makes contact with the first corner area, a second support which makes contact with the second corner area, a third support which makes contact with the third corner area, and a fourth support which makes contact with the fourth corner area.

In an embodiment of the disclosure, the supports may include, on the plane, a first support which makes contact with the first corner area, a second support which makes contact with the second corner area, a third support which makes contact with the first inside surface, a fourth support that makes contact with the third inside surface, and a fifth support which makes contact with the fourth inside surface.

In an embodiment of the disclosure, the fifth support may include a plurality of sub-supports spaced apart from each other on the plane.

In an embodiment of the disclosure, the supports may include, on the plane, a first support which makes contact with the first inside surface, a second support which makes contact with the second inside surface, a third support which makes contact with the third inside surface, and a fourth support which makes contact with the fourth inside surface.

In an embodiment of the disclosure, the supports may include, on the plane, a first support which makes contact with the first corner area and a second support which makes contact with the third corner area.

According to an embodiment, a panel packaging tray includes a packaging case including a sidewall which defines a receiving section in which a display panel is accommodated and a plurality of supports disposed on an inside surface of the sidewall, where the supports guide a position of the display panel on a plane defined to cross the inside surface. In such an embodiment, a support of the supports includes a fixing portion coupled with the sidewall and a buffer portion protruding from the fixing portion on the plane. In such an embodiment, the buffer portion includes a straight portion, a corner portion, and a curved portion located between the straight portion and the corner portion, based on a direction parallel to the plane. In such an embodiment, a curvature of a curved surface included in the curved portion is determined by a maximum tilt angle by which the display panel is allowed to be tilted in a state of being accommodated in the receiving section.

In an embodiment of the disclosure, each of the supports may include a first point at which the straight portion and the curved portion meet each other, a second point at which the curved portion and the corner portion meet each other, and a third point at which the corner portion and the packaging case meet each other. In such an embodiment, a direction parallel to the straight portion may be referred to as a first reference direction, and a direction parallel to a straight line defined to pass through the first point and the second point may be referred to as a second reference direction. In such an embodiment, the first reference direction and the second reference direction may cross each other, and an acute angle between the first reference direction and the second reference direction may be a first angle.

In an embodiment of the disclosure, the display panel may include a plurality of side surfaces. In such an embodiment, a side surface when the display panel makes contact with the curved portion in the state of being accommodated in the receiving section, among the plurality of side surfaces, may be referred to as an adjacent surface. In such an embodiment, an acute angle between the first reference direction and a direction parallel to the adjacent surface may be referred to as a tilt angle. In such an embodiment, the maximum tilt angle may be the largest value of the tilt angle.

In an embodiment of the disclosure, the first angle may be greater than or equal to the maximum tilt angle.

In an embodiment of the disclosure, the first angle may be smaller than twice the maximum tilt angle.

In an embodiment of the disclosure, when a direction parallel to a straight line defined to pass through the second point and the third point is referred to as a third reference direction, the first angle may differ from a second angle that is an acute angle between the second reference direction and the third reference direction.

In an embodiment of the disclosure, the first angle may be smaller than the second angle.

BRIEF DESCRIPTION OF THE DRAWINGS

The above and other features of embodiments of the disclosure will become apparent by describing in detail embodiments thereof with reference to the accompanying drawings.

FIGS. 4A and 4B are enlarged views of an area BB' illustrated in FIG. 3.

FIGS. 5A to 5D are enlarged views of the area BB' illustrated in FIG. 3.

FIG. 7 is an enlarged view of an area CC' illustrated in FIG. 6A.

FIG. 10 is an enlarged view of an area EE' illustrated in FIG. 9.

FIG. 12 is a cross-sectional view taken along line I-I' illustrated in FIG. 3.

DETAILED DESCRIPTION

Figure 1:
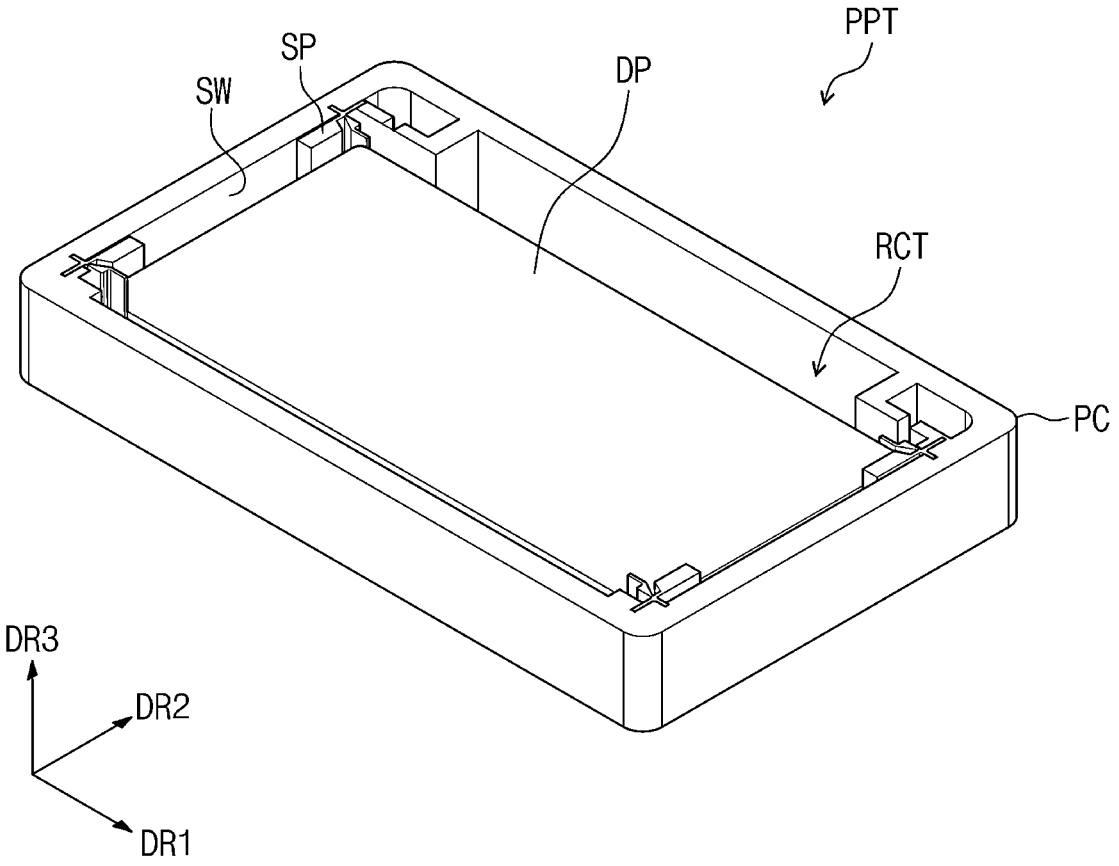
FIG. 1 is a perspective view of a panel packaging tray according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

In this specification, when it is mentioned that a component (or, an area, a layer, a part, etc.) is referred to as being "on", "connected to" or "coupled to" another component, this means that the component may be directly on, connected to, or coupled to the other component or a third component may be present therebetween.

Like reference numerals refer to like elements throughout. Additionally, in the drawings, the thicknesses, proportions, and dimensions of components are exaggerated for effective description. The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items.

Terms such as first, second, and the like may be used to describe various components, but the components should not be limited by the terms. The terms may be used only for distinguishing one component from other components. For example, without departing the scope of the disclosure, a first component may be referred to as a second component, and similarly, the second component may also be referred to as the first component. The terms of a singular form may include plural forms unless otherwise specified.

In addition, terms such as "below", "under", "above", and "over" are used to describe a relationship of components illustrated in the drawings. The terms are relative concepts and are described based on directions illustrated in the drawing.

It should be understood that terms such as "comprise", "include", and "have", when used herein, specify the presence of stated features, numbers, steps, operations, components, parts, or combinations thereof, but do not preclude the presence or addition of one or more other features, numbers, steps, operations, components, parts, or combinations thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

FIG. 1 is a perspective view of a panel packaging tray according to an embodiment of the disclosure.

Referring to FIG. 1, an embodiment of the panel packaging tray PPT includes a packaging case PC and a plurality of supports SP.

In an embodiment of the disclosure, as shown in FIG. 1, the packaging case PC has a rounded rectangular shape with long sides in a first direction DR1 and short sides in a second direction DR2 crossing the first direction DR1. However, the shape of the packaging case PC is not limited thereto, and the packaging case PC may have various shapes. In an embodiment of the disclosure, the shape of the packaging case PC may be determined based on the shape of a display panel DP to be accommodated in the panel packaging tray PPT.

In an embodiment of the disclosure, the packaging case PC includes a sidewall SW defining a receiving section RCT. The display panel DP may be accommodated in the receiving section RCT. The display panel DP may be accommodated in the receiving section RCT in a third direction DR3 that crosses the first direction DR1 and the second direction DR2. Here, the front surfaces (or the upper surfaces), the rear surfaces (or the lower surfaces), and the side surfaces of members are defined based on the third direction DR3. The front surfaces and the rear surfaces may be opposite each other in the third direction DR3, and the normal directions of the front surfaces and the rear surfaces may be parallel to the third direction DR3. Furthermore, the normal directions of the side surfaces may be directions perpendicular to the third direction DR3. In the phrase "on a plane", the plane may refer to a plane, the normal direction of which is parallel to the third direction DR3. Here, the phrase "in a plan view" may mean when viewed from a plan view in the third direction DR3.

In an embodiment of the disclosure, the packaging case PC may include or be formed of expanded polystyrene (EPS) or expanded polypropylene (EPP).

In an embodiment of the disclosure, the plurality of supports SP may be disposed on the inside surfaces of the sidewall SW of the packaging case PC. The plurality of supports SP may be disposed between the packaging case PC and the display panel DP in a state where the display panel DP is accommodated in the receiving section RCT. The shape and configuration of the plurality of supports SP will be described below with reference to FIGS. 3 to 5D.

Figure 2:
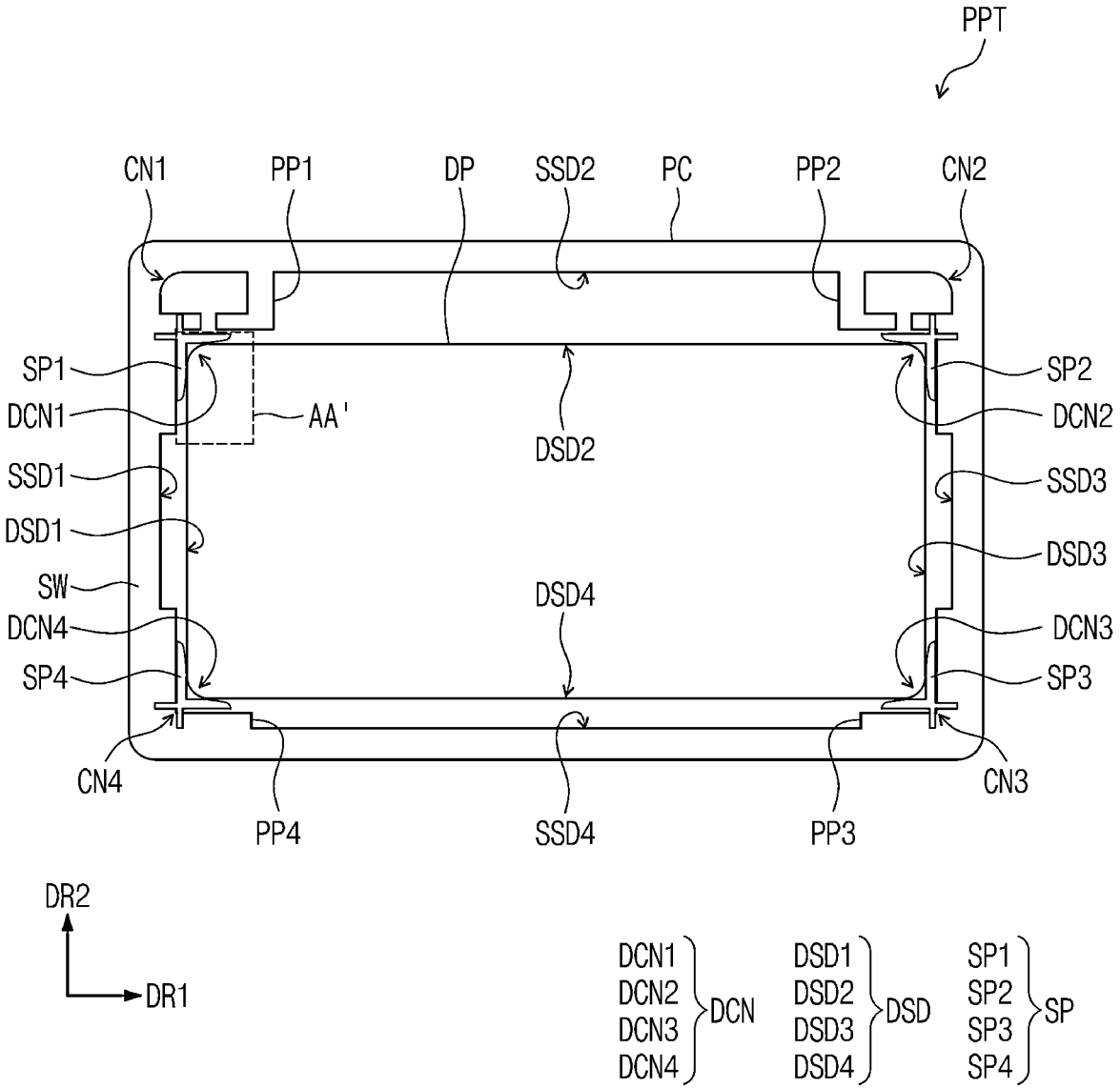
FIG. 2 is a plan view of the panel packaging tray according to an embodiment of the disclosure.

FIG. 2 is a plan view of the panel packaging tray according to an embodiment of the disclosure. Hereinafter, the same or like components in FIG. 2 as the components described above with reference to FIG. 1 will be assigned with the same or like reference numerals, and any repetitive detailed descriptions thereof will be omitted or simplified.

Referring to FIG. 2, the sidewall SW of the packaging case PC includes a first inside surface SSD1 and a third inside surface SSD3 that extend in the second direction DR2, and a second inside surface SSD2 and a fourth inside surface SSD4 that extend in the first direction DR1. The packaging case PC has a first corner area CN1 in which the first inside surface SSD1 and the second inside surface SSD2 meet each other, a second corner area CN2 in which the second inside surface SSD2 and the third inside surface SSD3 meet each other, a third corner area CN3 in which the third inside surface SSD3 and the fourth inside surface SSD4 meet each other, and a fourth corner area CN4 in which the fourth inside surface SSD4 and the first inside surface SSD1 meet each other.

In an embodiment of the disclosure, the sidewall SW may further include first to fourth protrusions PP1, PP2, PP3, and PP4. In an embodiment, the sidewall SW includes the first protrusion PP1 that protrudes from the first and second inside surfaces SSD1 and SSD2 in the first corner area CN1. The first protrusion PP1 may include a portion protruding from the first inside surface SSD1 in the first direction DR1 and a portion protruding from the second inside surface SSD2 in the direction opposite to the second direction DR2. The sidewall SW includes the second protrusion PP2 that protrudes from the second and third inside surfaces SSD2 and SSD3 in the second corner area CN2. The second protrusion PP2 may include a portion protruding from the second inside surface SSD2 in the direction opposite to the second direction DR2 and a portion protruding from the third inside surface SSD3 in the direction opposite to the first direction DR1. The sidewall SW includes the third protrusion PP3 that protrudes from the third and fourth inside surfaces SSD3 and SSD4 in the third corner area CN3. The third protrusion PP3 may include a portion protruding from the third inside surface SSD3 in the direction opposite to the first direction DR1 and a portion protruding from the fourth inside surface SSD4 in the second direction DR2. The sidewall SW includes the fourth protrusion PP4 that protrudes from the first and fourth inside surfaces SSD1 and SSD4 in the fourth corner area CN4. The fourth protrusion PP4 may include a portion protruding from the fourth inside surface SSD4 in the second direction DR2 and a portion protruding from the first inside surface SSD1 in the first direction DR1.

In such an embodiment where the sidewall SW includes the first to fourth protrusions PP1 to PP4, empty spaces may be defined or formed between the display panel DP accommodated in the panel packaging tray PPT and the inside surfaces SSD1 to SSD4, that is, the display panel DP accommodated in the panel packaging tray PPT is spaced apart from the inside surfaces SSD1 to SSD4 (or the first to fourth protrusions PP1 to PP4) in a state where the display panel DP is accommodated in the receiving section RCT. Accordingly, even when an impact is applied to the panel packaging tray PPT from the outside, the impact may be prevented from being transmitted from the packaging case PC to the display panel DP.

In an embodiment of the disclosure, the plurality of supports SP may include first to fourth supports SP1, SP2, SP3, and SP4. The first to fourth supports SP1 to SP4 may be coupled with the sidewall SW of the packaging case PC. in an embodiment, the first support SP1 may be coupled with one portion (e.g., the first protrusion PP1) of the sidewall SW in the first corner area CN1. The second support SP2 may be coupled with one portion (e.g., the second protrusion PP2) of the sidewall SW in the second corner area CN2. The third support SP3 may be coupled with one portion (e.g., the third protrusion PP3) of the sidewall SW in the third corner area CN3. The fourth support SP4 may be coupled with one portion (e.g., the fourth protrusion PP4) of the sidewall SW in the fourth corner area CN4. However, the disclosure is not limited thereto. In an alternative embodiment, where the sidewall SW does not include the protrusions, the first to fourth supports SP1 to SP4 may be directly coupled to the inside surfaces of the sidewall SW.

In an embodiment where the first to fourth supports SP1, SP2, SP3, and SP4 are disposed in the first to fourth corner areas CN1, CN2, CN3, and CN4, respectively, each of the first to fourth supports SP1, SP2, SP3, and SP4 may include a first support portion extending in the first direction DR1 and a second support portion extending in the second direction DR2.

In an embodiment of the disclosure, the display panel DP includes a plurality of side surfaces DSD1 to DSD4 and a plurality of corner portions DCN1 to DCN4. In an embodiment of the disclosure, the display panel DP includes the first side surface DSD1 and the third side surface DSD3 that extend in the second direction DR2 and the second side surface DSD2 and the fourth side surface DSD4 that extend in the first direction DR1. The display panel DP includes the first corner portion DCN1 at which the first side surface DSD1 and the second side surface DSD2 meet each other, the second corner portion DCN2 at which the second side surface DSD2 and the third side surface DSD3 meet each other, the third corner portion DCN3 at which the third side surface DSD3 and the fourth side surface DSD4 meet each other, and the fourth corner portion DCN4 at which the fourth side surface DSD4 and the first side surface DSD1 meet each other.

The display panel DP is accommodated in the panel packaging tray PPT in a way such that the first to fourth corner portions DCN1 to DCN4 correspond to the first to fourth supports SP1 to SP4, respectively. The first to fourth supports SP1 to SP4 guide the position of the display panel DP on the plane, thereby preventing the display panel DP accommodated in the panel packaging tray PPT from being shifted in the first direction DR1 or the second direction DR2. In such an embodiment, the first to fourth supports SP1 to SP4 may prevent the display panel DP accommodated in the panel packaging tray PPT from being tilted in one of directions crossing the first and second directions DR1 and DR2.

Figure 3:
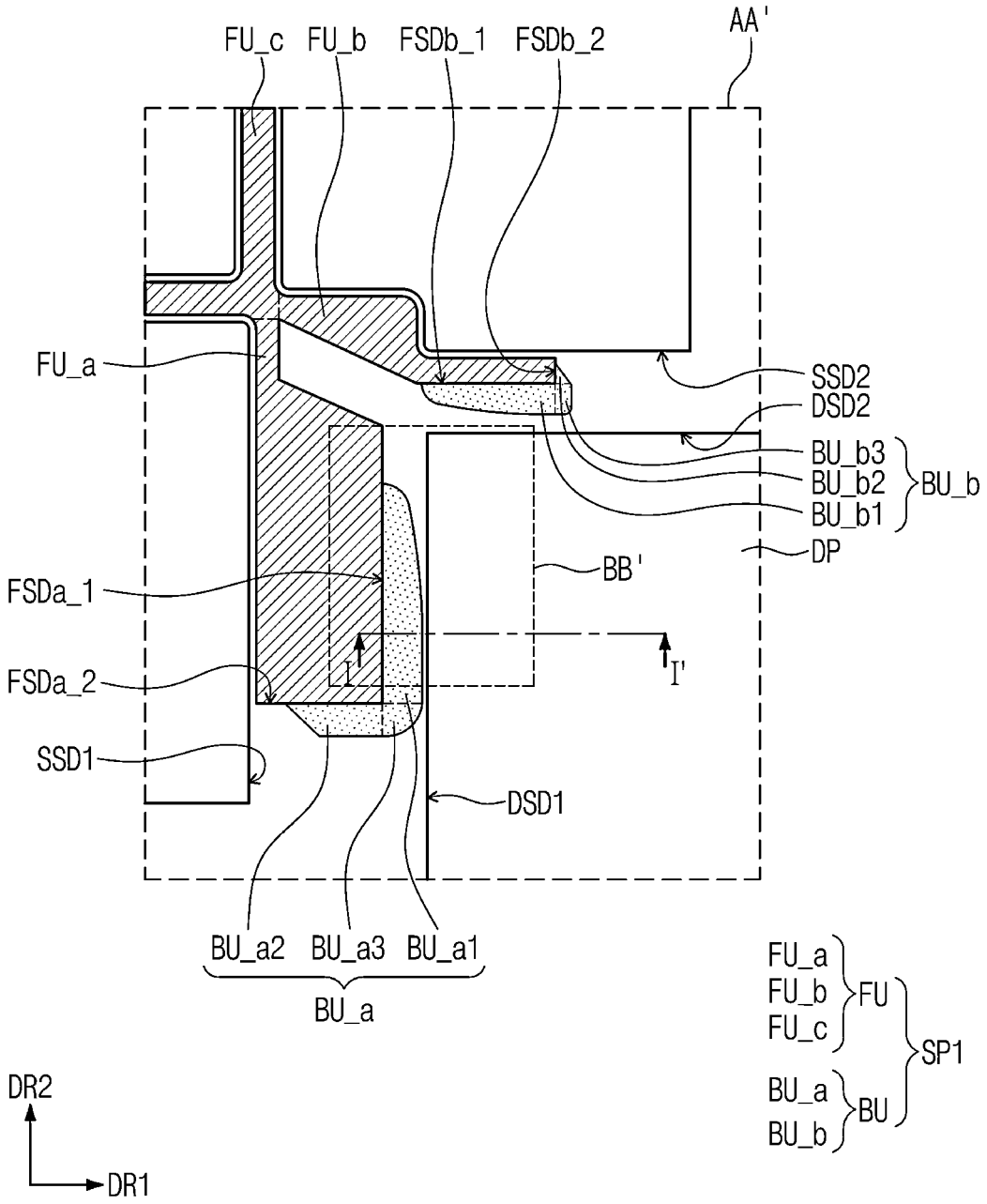
FIG. 3 is an enlarged view of an area AA' of the panel packaging tray illustrated in FIG. 2.

FIG. 3 is an enlarged view of an area AA' of the panel packaging tray illustrated in FIG. 2. Hereinafter, the same or like components in FIG. 3 as the components described above with reference to FIG. 2 will be assigned with the same or like reference numerals, and any repetitive detailed descriptions thereof will be omitted.

Referring to FIGS. 2 and 3, one support (e.g., the first support SP1) among the supports SP includes a fixing unit FU and a buffer unit BU. The other supports (e.g., the second to fourth supports SP2, SP3, and SP4) among the supports SP have a structure similar to the structure of the first support SP1, and therefore detailed descriptions of the second to fourth supports SP2, SP3, and SP4 will be omitted.

In an embodiment of the disclosure, a recess to which the fixing unit FU is coupled may be defined or formed on the sidewall SW of the packaging case PC. The fixing unit FU may be coupled with an inside surface of the sidewall SW of the packaging case PC. In an embodiment, the fixing unit FU includes a first fixing unit FU_a, a second fixing unit FU_b, and a third fixing unit FU_c. The third fixing unit FU_c may be press-fit into the recess defined or formed on the sidewall SW of the packaging case PC. The first fixing unit FU_a may be a portion extending from the third fixing unit FU_c in the second direction DR2. The second fixing unit FU_b may be a portion extending from the third fixing unit FU_c in the first direction DR1. In an embodiment of the disclosure, the first fixing unit FU_a may face the first inside surface SSD1 of the sidewall SW. In an embodiment of the disclosure, the second fixing unit FU_b may face the second inside surface SSD2 of the sidewall SW. In an embodiment of the disclosure, the fixing unit FU may be a mold including or made of a plastic material.

The buffer unit BU is disposed between the fixing unit FU and the display panel DP accommodated in the panel packaging tray PPT. In an embodiment of the disclosure, the buffer unit BU may include a first buffer unit BU_a and a second buffer unit BU_b. The first buffer unit BU_a may be disposed between the first fixing unit FU_a and the display panel DP on the plane. The second buffer unit BU_b may be disposed between the second fixing unit FU_b and the display panel DP on the plane.

In an embodiment of the disclosure, the first buffer unit BU_a includes a first sub-buffer unit BU_a1 disposed on or in contact with a first surface FSDa_1 of the first fixing unit FU_a, a second sub-buffer unit BU_a2 disposed on or in contact with a second surface FSDa_2 of the first fixing unit FU_a, and a third sub-buffer unit BU_a3 connected between the first sub-buffer unit BU_a1 and the second sub-buffer unit BU_a2. The normal line of the first surface FSDa_1 is parallel to the first direction DR1. The normal line of the second surface FSDa_2 is parallel to the second direction DR2.

In an embodiment of the disclosure, the second buffer unit BU_b includes a fourth sub-buffer unit BU_b1 disposed on or in contact with a third surface FSDb_1 of the second fixing unit FU_b, a fifth sub-buffer unit BU_b2 disposed on or in contact with a fourth surface FSDb_2 of the second fixing unit FU_b, and a sixth sub-buffer unit BU_b3 connected between the fourth sub-buffer unit BU_b1 and the fifth sub-buffer unit BU_b2. The normal line of the third surface FSDb_1 is parallel to the second direction DR2. The normal line of the fourth surface FSDb_2 is parallel to the first direction DR1.

In an embodiment of the disclosure, curved portions CVP (refer to FIG. 4A) of the buffer unit BU, which will be described below, are defined or formed in the first sub-buffer unit BU_a1 and the fourth sub-buffer unit BU_b1, respectively. In such an embodiment, the curved portions CVP provided in the first and fourth sub-buffer units BU_a1 and BU_b1 are formed to have a decreasing thickness toward a portion adjacent to the third fixing unit FU_c. In an embodiment, the curved portion of the first sub-buffer unit BU_a1 is in contact with the first surface FSDa_1 and has a curved surface CV1 (refer to FIG. 4A) with a first curvature based on the second direction DR2. The curved portion of the fourth sub-buffer unit BU_b1 is in contact with the third surface FSDb_1 and has a curved surface with the first curvature based on the first direction DR1.

The first and second buffer units BU_a and BU_b may include or contain polyurethane. In an embodiment of the disclosure, the first and second buffer units BU_a and BU_b may have a lower hardness than the fixing unit FU. In an embodiment of the disclosure, the first and second buffer units BU_a and BU_b may have a higher hardness than the packaging case PC.

The display panel DP accommodated in the panel packaging tray PPT may make contact with the buffer unit BU when tilted by an external impact. Specifically, the first side surface DSD1 of the display panel DP may make contact with the first buffer unit BU_a. The first side surface DSD1 of the display panel DP may make contact with the first sub-buffer unit BU_a1 and the third sub-buffer unit BU_a3. The second side surface DSD2 of the display panel DP may make contact with the second buffer unit BU_b. The second side surface DSD2 of the display panel DP may make contact with the fourth sub-buffer unit BU_b1 and the sixth sub-buffer unit BU_b3. In an embodiment, the first and second buffer units BU_a and BU_b are disposed between the display panel DP and the fixing unit FU, such that the display panel DP makes contact with the first and second buffer units BU_a and BU_b having a lower hardness without making direct contact with the fixing unit FU having a higher hardness even when the display panel DP is tilted. Accordingly, an impact applied from the outside may be alleviated by the first and second buffer units BU_a and BU_b, and thus damage to the display panel DP due to the impact may be effectively prevented.

Figure 4A:
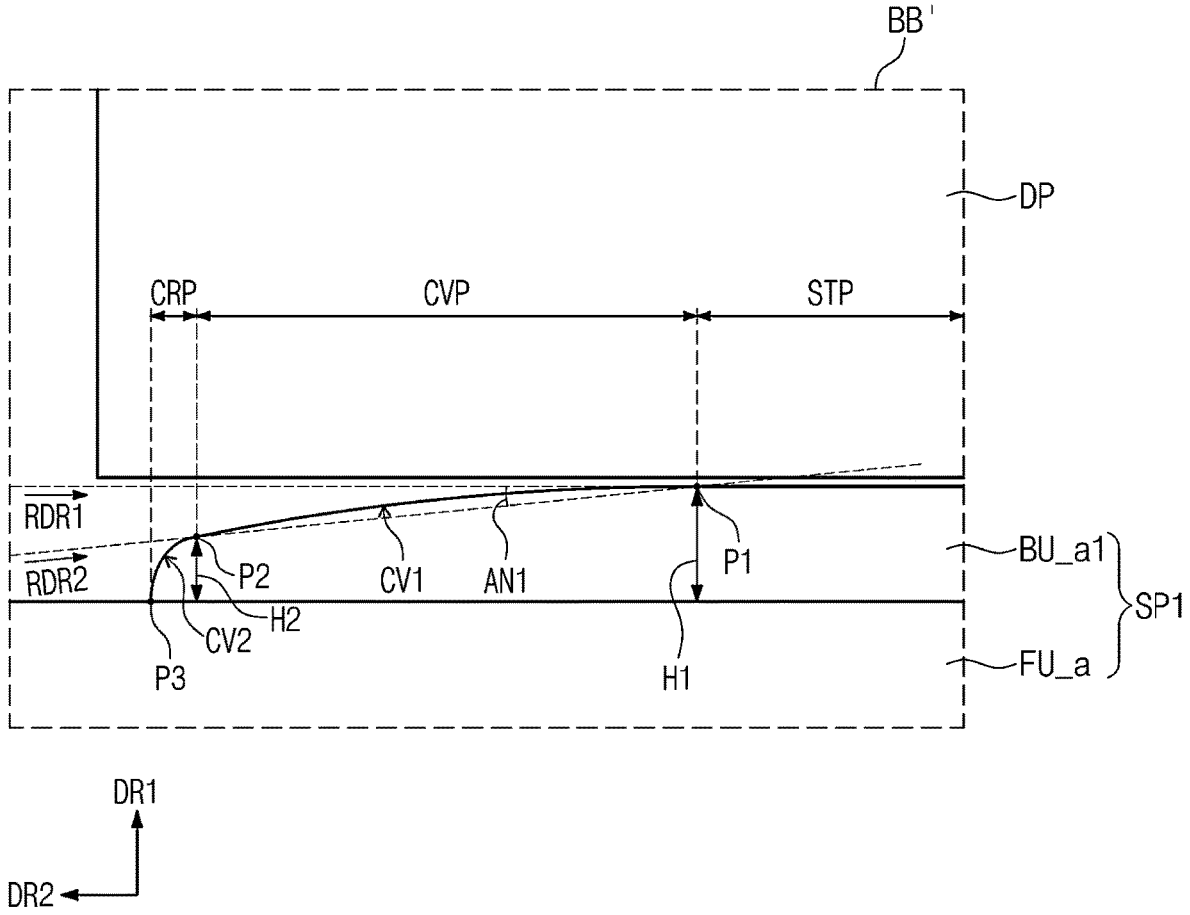
FIGS. 4A and 4B are views for describing a relationship between a maximum tilt angle and the shape of a support according to an embodiment of the disclosure, where
Figure 4B:
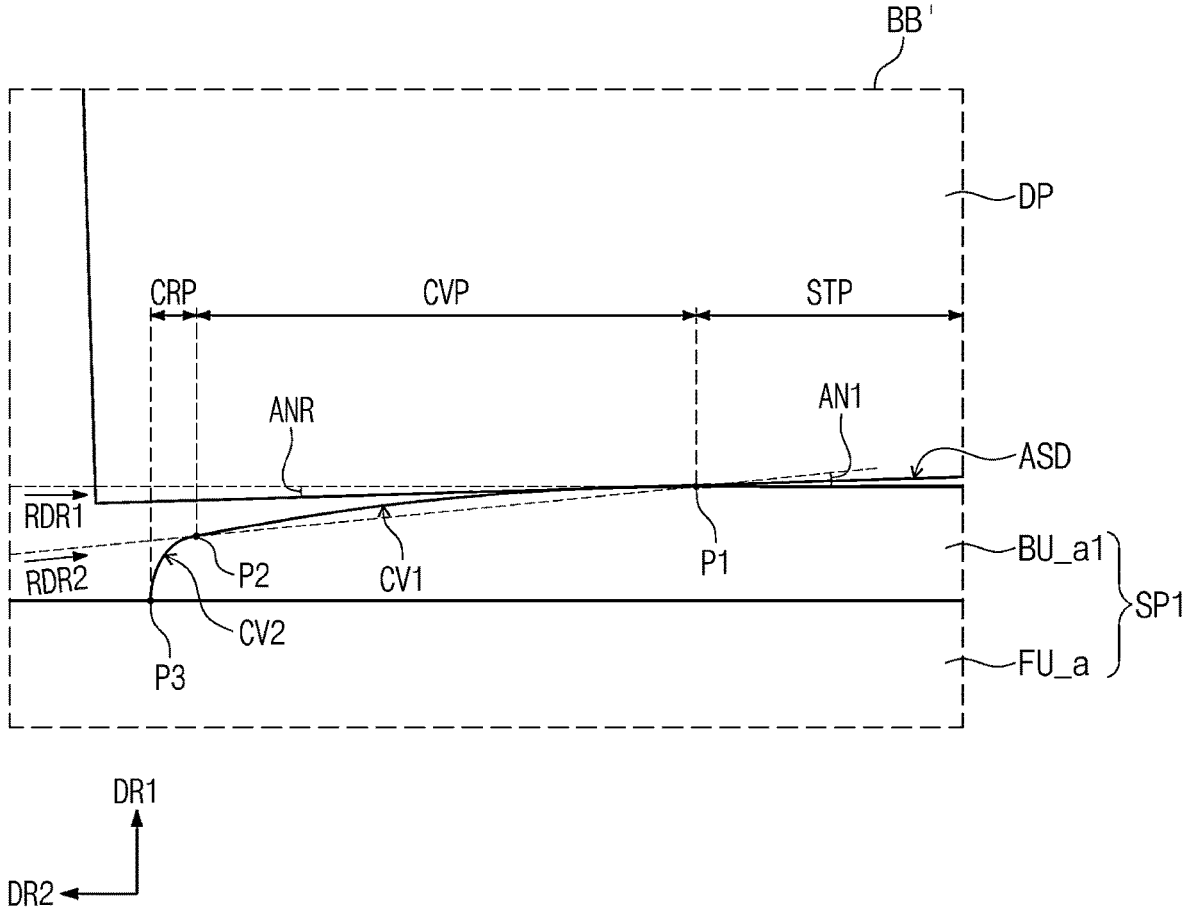

FIGS. 4A and 4B are views for describing a relationship between a maximum tilt angle and the shape of a support according to an embodiment of the disclosure, where FIGS. 4A and 4B are enlarged views of an area BB' illustrated in FIG. 3.

Referring to FIGS. 3 and 4A, the first sub-buffer unit BU_a1 and the first fixing unit FU_a included in the first support SP1 are illustrated in FIG. 4A. The fourth sub-buffer unit BU_b1 included in the first support SP1 has a structure similar to that of the first sub-buffer unit BU_a1, and the second fixing unit FU_b has a structure similar to that of the first fixing unit FU_a. Therefore, detailed descriptions of the fourth sub-buffer unit BU_b1 and the second fixing unit FU_b will be omitted.

The first sub-buffer unit BU_a1 includes a straight portion STP, a corner portion CRP, and the curved portion CVP located between the straight portion STP and the corner portion CRP. In an embodiment of the disclosure, the point at which the straight portion STP and the curved portion CVP meet each other may be referred to as a first point P1, the point at which the curved portion CVP and the corner portion CRP meet each other may be referred to as a second point P2, and the point at which the corner portion CRP and the first fixing unit FU_a meet each other may be referred to as a third point P3. In an embodiment of the disclosure, a direction parallel to the straight portion STP may be referred to as a first reference direction RDR1, and a direction parallel to a straight line passing through the first point P1 and the second point P2 may be referred to as a second reference direction RDR2. The length of the first sub-buffer unit BU_a1 in the first direction DR1 at the first point P1 is referred to as the first length H1. The length of the first sub-buffer unit BU_a1 in the first direction DR1 at the second point P2 is referred to as the second length H2. In an embodiment, the first length H1 is longer than the second length H2. Accordingly, the first reference direction RDR1 and the second reference direction RDR2 cross each other. In an embodiment of the disclosure, an acute angle between the first reference direction RDR1 and the second reference direction RDR2 is referred to as a first angle AN1.

In an embodiment of the disclosure, the curved portion CVP is formed to have the curved surface CV1 (hereinafter, referred to as the first curved surface) with the first curvature based on the second direction DR2. The corner portion CRP is formed to have a curved surface CV2 (hereinafter, referred to as the second curved surface) with a second curvature based on the second direction DR2. A relationship between the first curvature and the second curvature will be described below with reference to FIG. 4B.

Referring to FIG. 4B, in an embodiment, the display panel DP accommodated in the panel packaging tray PPT (refer to FIG. 2) may be tilted or in a tilted position in the receiving section RCT, that is, in a position where the side surfaces DSD1 to DSD4 of the display panel DP are not parallel to the first direction DR1 or the second direction DR2. The display panel DP in the tilted position (hereinafter, will be referred to as "tilted display panel") may make contact with the first support SP1 that guides the position of the display panel DP on the plane. in an embodiment, the tilted display panel DP may make contact with the first sub-buffer unit BU_a1 included in the first support SP1. Hereinafter, the same or like components in FIG. 4B as the components described above with reference to FIG. 4A will be assigned with the same or like reference numerals, and any repetitive detailed descriptions thereof will be omitted.

In an embodiment of the disclosure, where the first sub-buffer unit BU_a1 includes the curved portion CVP, the curved portion CVP may be pressed by the load of the tilted display panel DP. Accordingly, the area by which the first sub-buffer unit BU_a1 and the tilted display panel DP make contact with each other is relatively increased. In a case, where the first buffer unit BU_a does not include the curved portion CVP, the corner portion CRP is pressed by the load of the tilted display panel DP. Accordingly, the area by which the first sub-buffer unit BU_a1 and the tilted display panel DP make contact with each other is relatively decreased. Thus, in an embodiment, where the first sub-buffer unit BU_a1 includes the curved portion CVP, the area by which the tilted display panel DP and the first sub-buffer unit BU_a1 make contact with each other may be increased, and a force (e.g., a repulsive force) applied to the display panel DP may be effectively prevented from being concentrated on any one point or a portion have a small area. An undesired effect that may occur when the force applied to the tilted display panel DP is concentrated on any one point and an effect when the force applied to the tilted display panel DP is distributed as in an embodiment of the invention without being concentrated on any one point will be described below with reference to FIG. 11.

In an embodiment of the disclosure, a side surface of the display panel DP that makes contact with the curved portion CVP among the side surfaces DSD (refer to FIG. 2) of the tilted display panel DP may be referred to as an adjacent surface ASD. In this case, an acute angle between the first reference direction RDR1 and a direction parallel to the adjacent surface ASD is referred to as a tilt angle. In an embodiment of the disclosure, the tilt angle when the tilted display panel DP makes contact with at least two supports and is not tilted any more may be referred to as the maximum tilt angle ANR. In an embodiment of the disclosure, the maximum tilt angle ANR may be the largest of the tilt angles. Hereinafter, for convenience of description, it is assumed that the tilt angle between the adjacent surface ASD and the first reference direction RDR1 is the maximum tilt angle ANR.

In an embodiment of the disclosure, the first angle AN1 is greater than or equal to the maximum tilt angle ANR. In an embodiment, the first sub-buffer unit BU_a1 includes the curved portion CVP having the first curved surface CV1 to allow the first angle AN1 to be greater than or equal to the maximum tilt angle ANR. The first curvature of the first curved surface CV1 is determined by the maximum tilt angle ANR. Specifically, the first curvature may be determined by the length of the curved portion CVP in the second direction DR2 and the maximum tilt angle ANR. In an embodiment of the disclosure, when the length of the curved portion CVP in the second direction DR2 is constant, the first curvature is increased as the maximum tilt angle ANR is increased. In an embodiment of the disclosure, when the maximum tilt angle ANR is constant, the first curvature is decreased as the length of the curved portion CVP in the second direction DR2 is increased.

When the display panel DP is tilted by the maximum tilt angle ANR, the curved portion CVP is pressed by the load of the tilted display panel DP. In this case, when the first angle AN1 is equal to the maximum tilt angle ANR, the display panel DP makes contact with the curved portion CVP and the second point P2 of the first sub-buffer unit BU_a1. When the first angle AN1 is greater than the maximum tilt angle ANR, the display panel DP makes contact with the curved portion CVP of the first sub-buffer unit BU_a1 and does not make contact with the second point P2 of the first sub-buffer unit BU_a1. Accordingly, in an embodiment where the first angle AN1 is greater than or equal to the maximum tilt angle ANR, the tilted display panel DP makes contact with at least the curved portion CVP of the first sub-buffer unit BU_a1 irrespective of the shape of the corner portion CRP. In an embodiment of the disclosure, even when the corner portion CRP has the second surface with the second curvature greater than the first curvature, a force applied to the display panel DP may be effectively prevented from being concentrated on any one point (e.g., a point corresponding to the corner portion CRP) because the tilted display panel DP does not make contact with the corner portion CRP.

In an embodiment, the first angle AN1 is smaller than twice the maximum tilt angle ANR. In an embodiment of the disclosure, where the maximum tilt angle ANR is 3°, the first angle AN1 may be 5°.

In an embodiment of the disclosure, the straight portion STP of the first sub-buffer unit BU_a1 guides the position of the display panel DP in the first direction DR1 that is a direction normal to the first reference direction RDR1. If the length of the curved portion CVP of the first sub-buffer unit BU_a1 in the second direction DR2 is too long, the length of the straight portion STP of the first sub-buffer unit BU_a1 in the second direction DR2 is too short so that the position of the display panel DP in the first direction DR1 cannot be guided. Accordingly, in an embodiment, the length of the curved portion CVP in the second direction DR2 may not exceed a predetermined percentage of the length of the first sub-buffer unit BU_a1 in the second direction DR2 (e.g., 70% of the length of the first sub-buffer unit BU_a1 in the second direction DR2, hereinafter referred to as the maximum percentage).

If the first angle AN1 is greater than or equal to twice the maximum tilt angle ANR, the area by which the tilted display panel DP and the first sub-buffer unit BU_a1 make contact with each other may be decreased even though the length of the curved portion CVP in the second direction DR2 is formed to have the maximum percentage, and therefore a force applied to the display panel DP may be concentrated on any one point. In an embodiment, the first angle AN1 is smaller than twice the maximum tilt angle ANR, such that the area by which the tilted display panel DP and the first sub-buffer unit BU_a1 make contact with each other may be increased even though the length of the curved portion CVP in the second direction DR2 is formed to have the maximum percentage or less, and thus a force applied to the display panel DP may be effectively prevented from being concentrated on any one point.

FIGS. 5A to 5D are views for describing the shapes of supports according to embodiments of the disclosure, where FIGS. 5A to 5D are enlarged views of the area BB' illustrated in FIG. 3. Hereinafter, for convenience of description, the same or like components in FIGS. 5A to 5D as the components described above with reference to FIGS. 4A and 4B will be assigned with the same or like reference numerals, and any repetitive detailed descriptions thereof will be omitted.

Figure 5A:
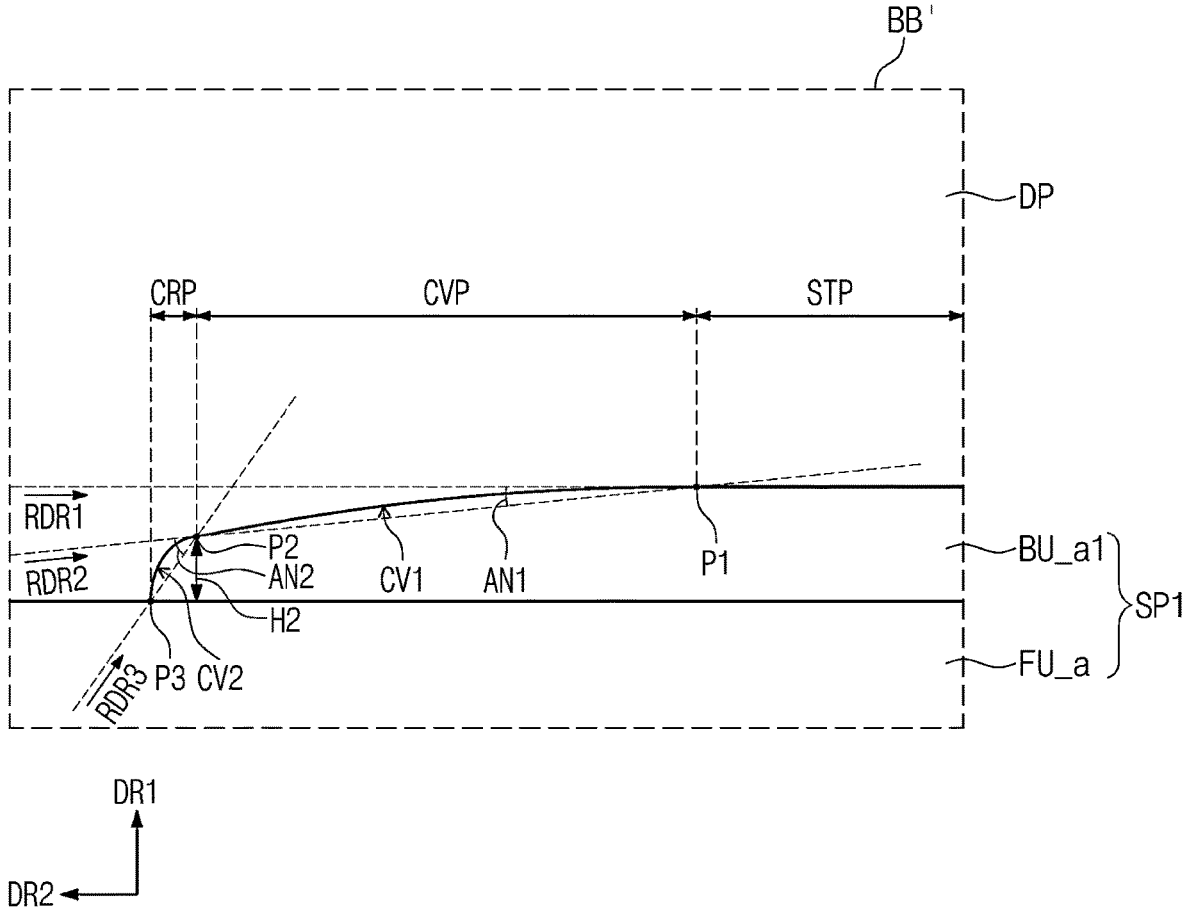
FIGS. 5A to 5D are views for describing the shapes of supports according to embodiments of the disclosure, where

Referring to FIG. 5A, in an embodiment of the disclosure, a direction parallel to a straight line passing through the second point P2 and the third point P3 may be referred to as a third reference direction RDR3. In an embodiment of the disclosure, the corner portion CRP has the second curved surface CV2 with the second curvature different from the first curvature and is formed to make contact with the first fixing unit FU_a. Accordingly, the second reference direction RDR2 and the third reference direction RDR3 cross each other. In an embodiment of the disclosure, an acute angle between the second reference direction RDR2 and the third reference direction RDR3 is referred to as a second angle AN2.

In an embodiment of the disclosure, the length of the corner portion CRP in the second direction DR2 is shorter than the length of the curved portion CVP in the second direction DR2, and the second curvature of the second curved surface CV2 is greater than the first curvature of the first curved surface CV1. Accordingly, the first angle AN1 is smaller than the second angle AN2.

The curved portion CVP may be an area for distributing the load of the display panel DP when the display panel DP accommodated in the panel packaging tray PPT (refer to FIG. 2) is tilted. In a case, where the first sub-buffer unit BU_a1 includes only the straight portion STP and the curved portion CVP without the corner portion CRP, the length of the first sub-buffer unit BU_a1 in the second direction DR2 may be undesirably increased. Accordingly, in an embodiment, the length of the first sub-buffer unit BU_a1 in the second direction DR2 may be adjusted to a desired length by disposing the corner portion CRP.

Figure 5B:
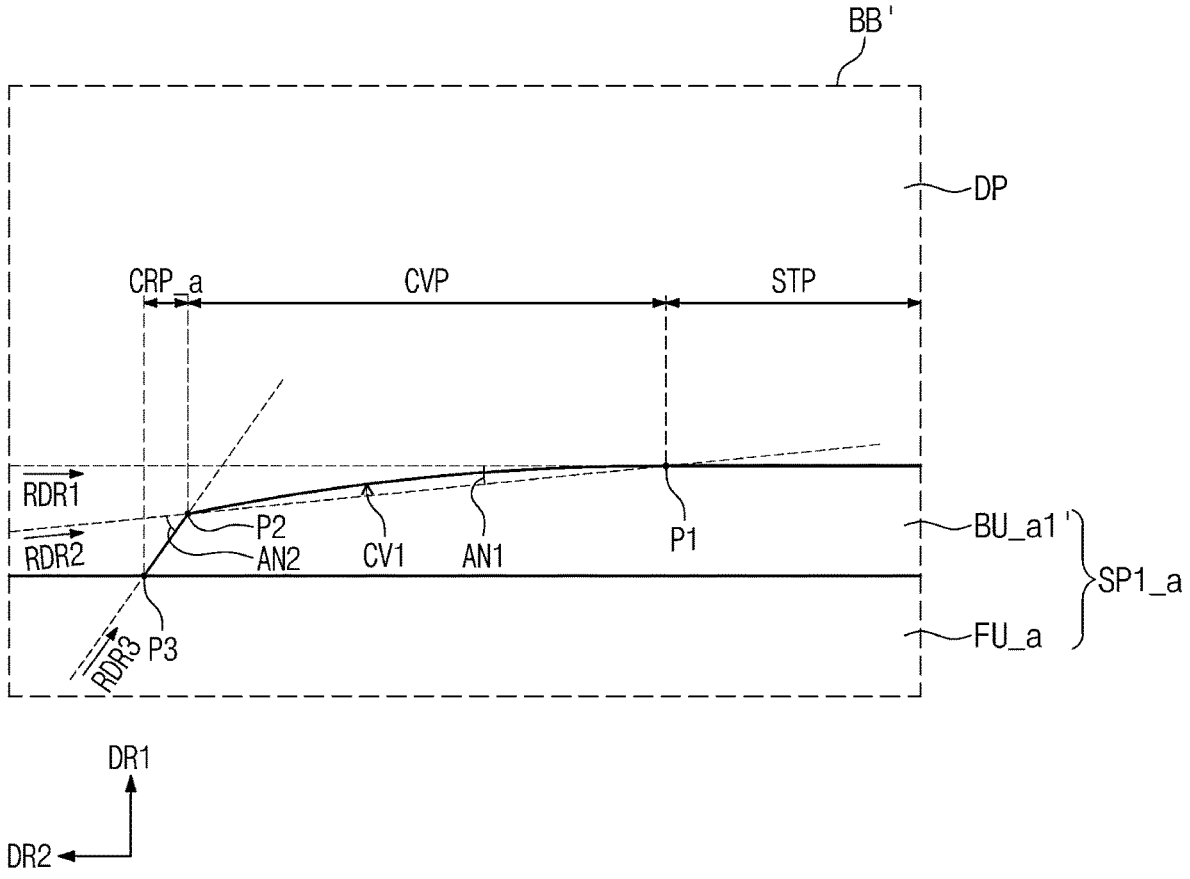

Referring to FIG. 5B, in an alternative embodiment, a first support SP1_*a* includes a first fixing unit FU_a and a first sub-buffer unit BU_a1'. A corner portion CRP_a of the first sub-buffer unit BU_a1' may be formed to have the shape of a straight line passing through a second point P2 and a third point P3. The first sub-buffer unit BU_a1' includes a curved portion CVP having a first curved surface CV1 with a first curvature. Accordingly, even when the display panel DP is tilted, the tilted display panel DP does not make contact with the second point P2. Thus, damage to the tilted display panel DP may be effectively prevented even when the corner portion CRP_a is formed to have the shape of a straight line.

Figure 5C:
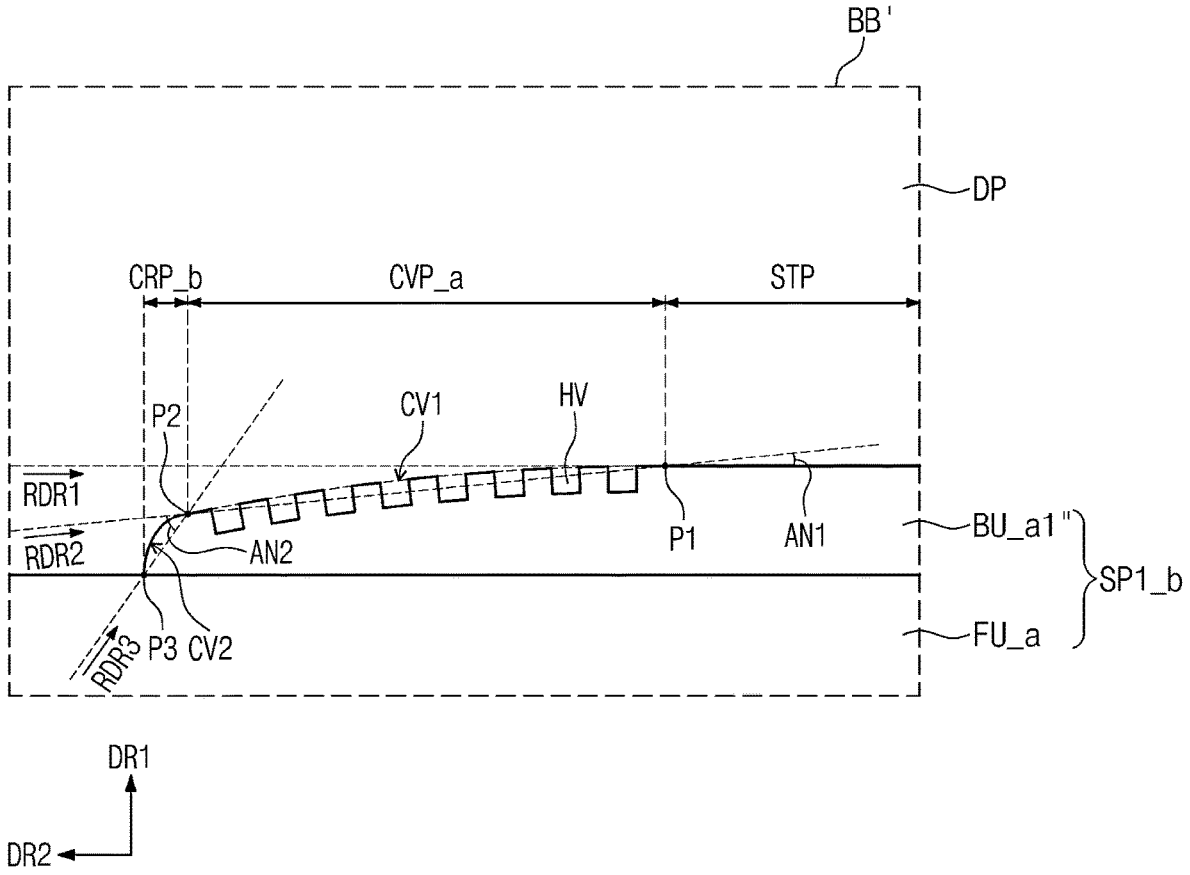

Referring to FIG. 5C, in another alternative embodiment, a first support SP1_*b* includes a first fixing unit FU_a and a first sub-buffer unit BU_a1". A curved portion CVP_a of the first sub-buffer unit BU_a1" has a first curved surface CV1 with a first curvature and includes a plurality of grooves HV recessed from the first curved surface CV1. In an embodiment of the present disclosure, where the first sub-buffer unit BU_a1" includes the grooves HV, process efficiency may be raised by reducing a frictional force due to the contact area between the display panel DP and the first sub-buffer unit BU_a1" when the display panel DP is accommodated in the panel packaging tray PPT (refer to FIG. 2) or the accommodated display panel DP is removed from the panel packaging tray PPT. In such an embodiment where the curved portion CVP_a includes the grooves HV, the display panel DP (refer to FIG. 2) tilted on the plane makes contact with the first curved surface CV1 including the grooves HV. In an embodiment of the disclosure, the curved portion CVP_a pressed by the load of the tilted display panel DP may extend toward the grooves HV. Accordingly, a repulsive force applied to the display panel DP may be decreased, and thus damage to the display panel DP may be effectively prevented.

Figure 5D:
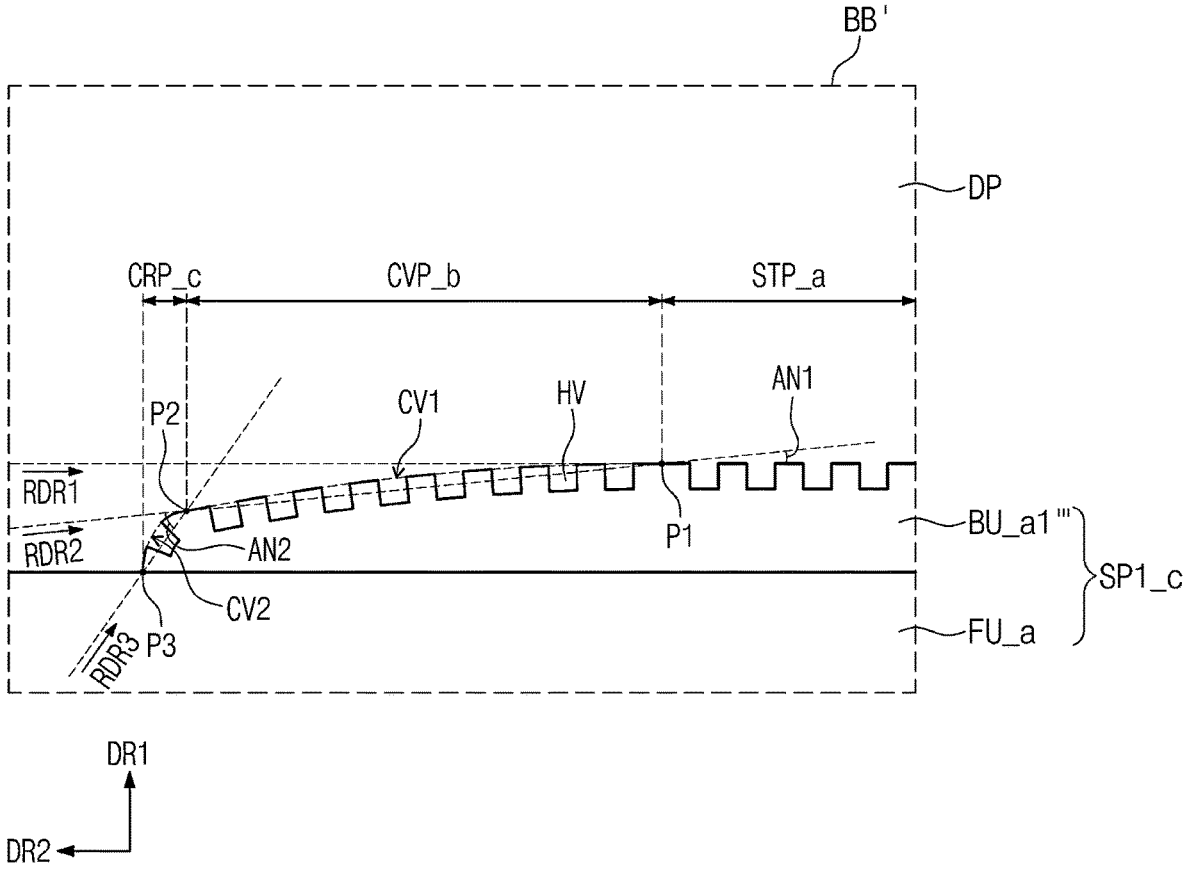

Referring to FIG. 5D, in another alternative embodiment, a first support SP1_*c* includes a first fixing unit FU_a and a first sub-buffer unit BU_a1'". A curved portion CVP_b of the first sub-buffer unit BU_a1'" has a first curved surface CV1 with a first curvature and includes a plurality of grooves HV recessed from the first curved surface CV1. A straight portion STP_a has a shape parallel to the first reference direction RDR1. A corner portion CRP_c has a second curved surface CV2 with a second curvature and includes a plurality of grooves HV recessed from the second curved surface CV2.

Figure 6A:
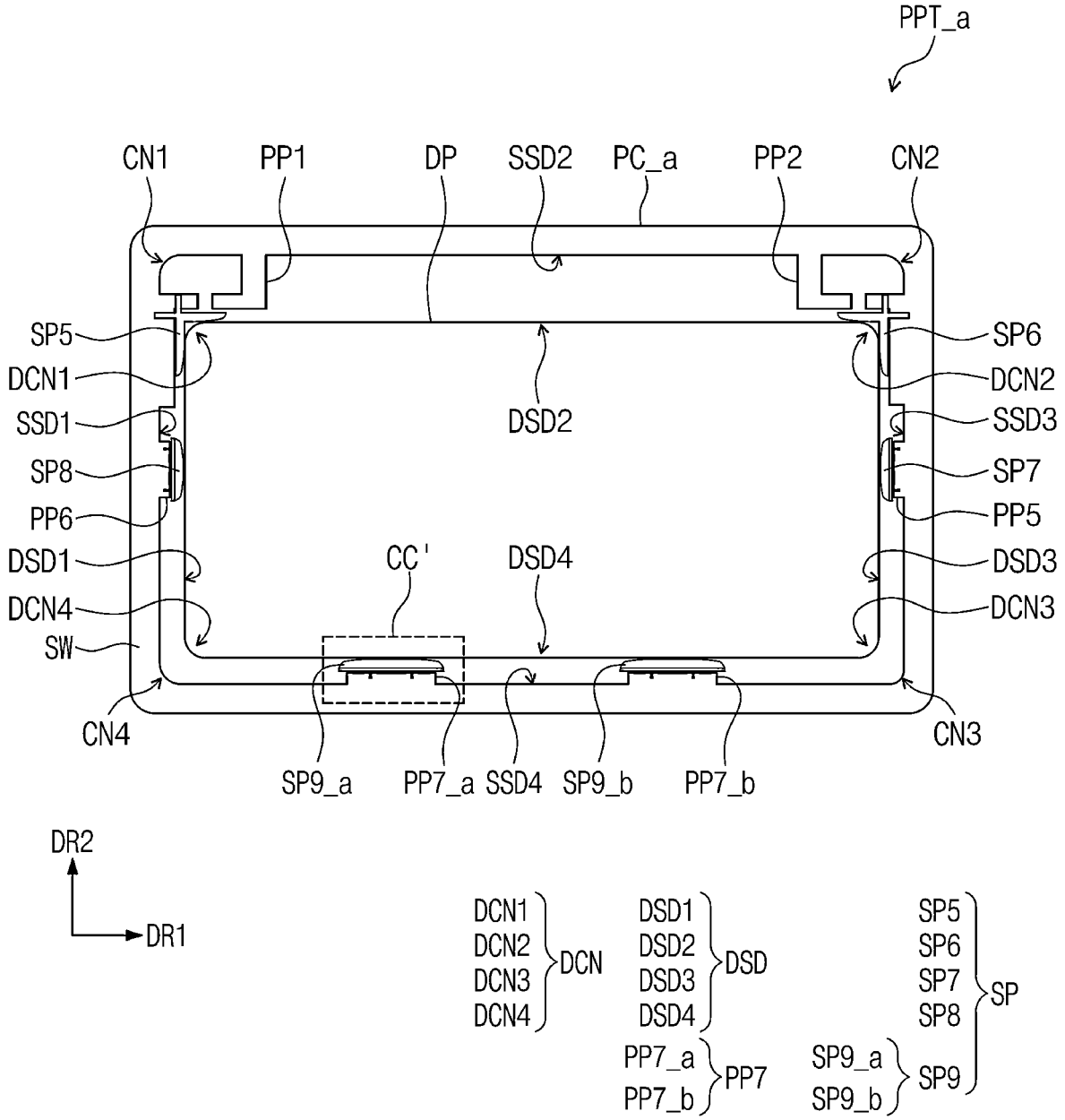
FIGS. 6A to 6C are plan views of panel packaging trays according to embodiments of the disclosure.
Figure 6B:
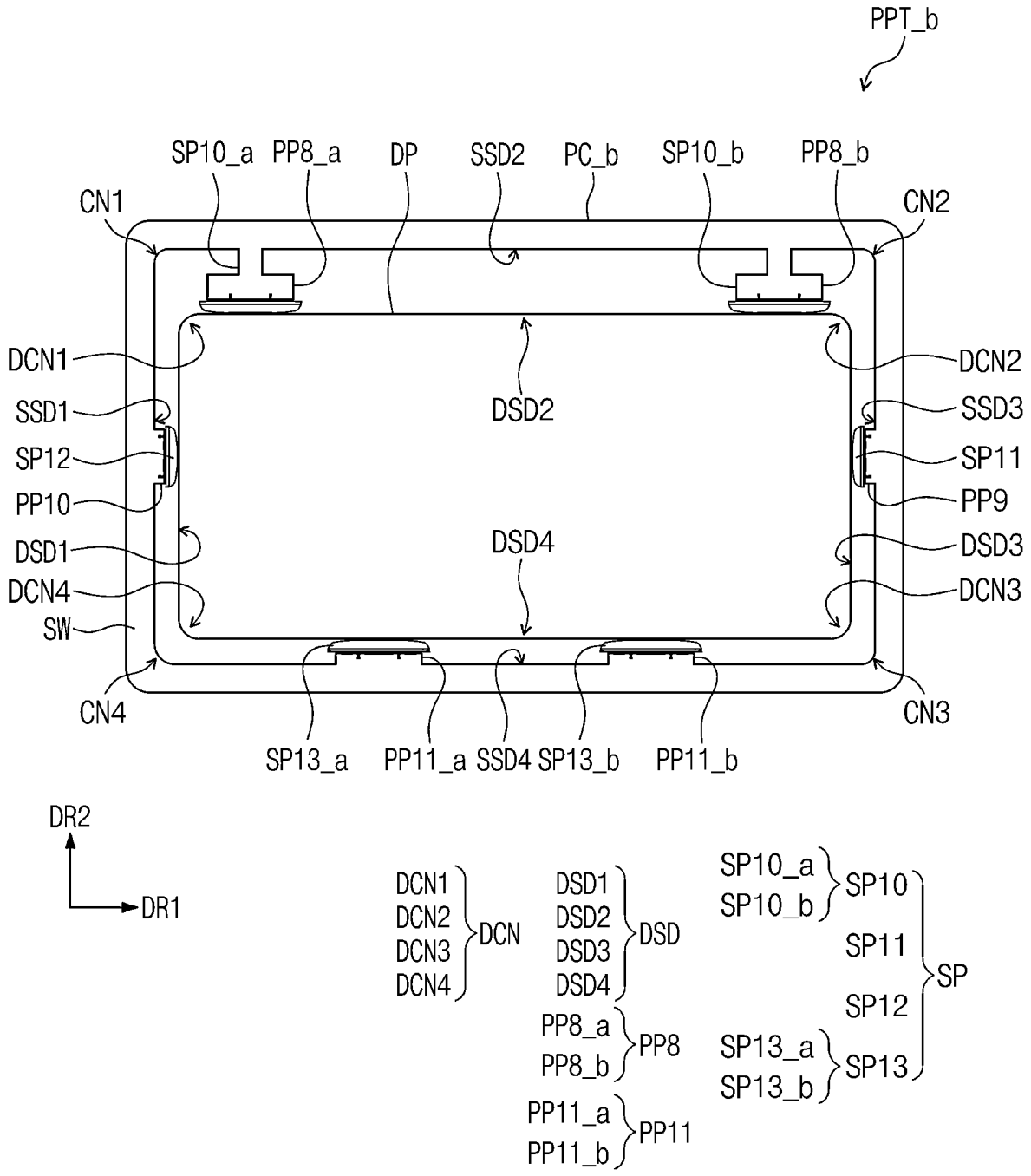
Figure 6C:
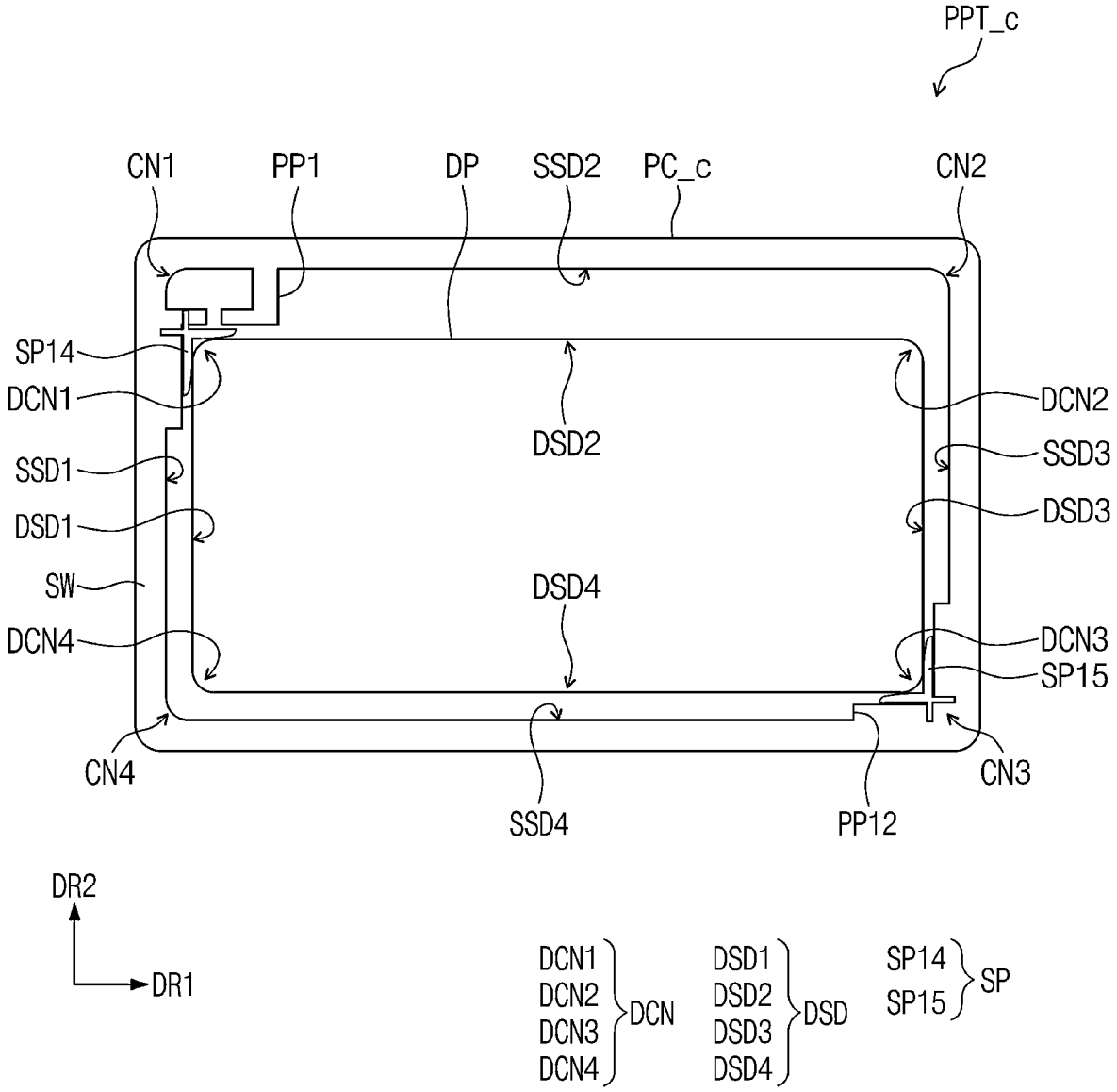

FIGS. 6A to 6C are plan views of panel packaging trays according to embodiments of the disclosure.

Referring to FIG. 6A, in an embodiment of in a panel packaging tray PPT_a, a plurality of supports SP include fifth to ninth supports SP5, SP6, SP7, SP8, and SP9. Hereinafter, the same or like components in FIG. 6A as the components described above with reference to FIG. 2 will be assigned with the same or like reference numerals, and any repetitive detailed descriptions thereof will be omitted.

In an embodiment of the disclosure, a sidewall SW of a packaging case PC_a may further include a first protrusion PP1, a second protrusion PP2, a fifth protrusion PP5, a sixth protrusion PP6, and a seventh protrusion PP7. In such an embodiment, the fifth protrusion PP5 may be a portion protruding from a third inside surface SSD3 in the direction opposite to the first direction DR1. The sixth protrusion PP6 may be a portion protruding from a first inside surface SSD1 in the first direction DR1. The seventh protrusion PP7 may be a portion protruding from a fourth inside surface SSD4 in the second direction DR2. In an embodiment of the disclosure, the seventh protrusion PP7 may include a first sub-protrusion PP7_*a* and a second sub-protrusion PP7_*b* spaced apart from each other in the first direction DR1.

The fifth support SP5 may be coupled with one portion (e.g., the first protrusion PP1) of the sidewall SW in a first corner area CN1. The sixth support SP6 may be coupled with one portion (e.g., the second protrusion PP2) of the sidewall SW in a second corner area CN2. The seventh support SP7 may be coupled with one portion (e.g., the fifth protrusion PP5) of the sidewall SW. The eighth support SP8 may be coupled with one portion (e.g., the sixth protrusion PP6) of the sidewall SW. The ninth support SP9 may be coupled with one portion (e.g., the seventh protrusion PP7) of the sidewall SW. However, the disclosure is not limited thereto. In an alternative embodiment, where the sidewall SW does not include the protrusions, the fifth to ninth supports SP5 to SP9 may be directly coupled to the inside surfaces of the sidewall SW.

In an embodiment of the disclosure, the ninth support SP9 may include a first sub-support SP9_*a* and a second sub-support SP9_*b*. The first sub-support SP9_*a* and the second sub-support SP9_*b* may be disposed to be spaced apart from each other in the first direction DR1. In an embodiment of the disclosure, the first sub-support SP9_*a* may be coupled with the first sub-protrusion PP7_*a* included in the sidewall SW. The second sub-support SP9_*b* may be coupled with the second sub-protrusion PP7_*b* included in the sidewall SW. In such an embodiment the first sub-support SP9_*a* and the second sub-support SP9_*b* spaced apart from each other in the first direction DR1 guide the position of a display panel DP, such that an effect of preventing the display panel DP from being shifted in the direction opposite to the second direction DR2 may be increased. In such an embodiment, an effect of preventing the display panel DP from being tilted in a direction crossing the second direction DR2 may be increased.

Each of the fifth and sixth supports SP5 and SP6 may include a first support portion extending in the first direction DR1 and a second support portion extending in the second direction DR2.

Each of the seventh and eighth supports SP7 and SP8 may include a third support portion extending in the second direction DR2. Each of the first and second sub-supports SP9_*a* and SP9_*b* may include a fourth support portion extending in the first direction DR1.

When the display panel DP is accommodated in a panel packaging tray PPT_a, a first corner portion DCN1 of the display panel DP faces the fifth support SP5, and a second corner portion DCN2 of the display panel DP faces the sixth support SP6. Furthermore, when the display panel DP is accommodated in the panel packaging tray PPT_a, a third side surface DSD3 of the display panel DP faces the seventh support SP7, a first side surface DSD1 of the display panel DP faces the eighth support SP8, and a fourth side surface DSD4 of the display panel DP faces the first and second sub-supports SP9_*a* and SP9_*b*. In an embodiment of the disclosure, when the display panel DP accommodated in the panel packaging tray PPT_a is tilted, the tilted display panel DP may make contact with at least one support among the fifth to ninth supports SP5, SP6, SP7, SP8, and SP9.

Referring to FIG. 6B, in an embodiment of in a panel packaging tray PPT_b, a plurality of supports SP include tenth to thirteenth supports SP10, SP11, SP12, and SP13. Hereinafter, the same or like components in FIG. 6B as the components described above with reference to FIGS. 2 and 6A will be assigned with the same or like reference numerals, and any repetitive detailed descriptions thereof will be omitted.

In an embodiment of the disclosure, a sidewall SW of a packaging case PC_b may include an eighth protrusion PP8, a ninth protrusion PP9, a tenth protrusion PP10, and an eleventh protrusion PP11. In such an embodiment, the eighth protrusion PP8 may be a portion protruding from a second inside surface SSD2 in the direction opposite to the second direction DR2. The ninth protrusion PP9 may be a portion protruding from a third inside surface SSD3 in the direction opposite to the first direction DR1. The tenth protrusion PP10 may be a portion protruding from a first inside surface SSD1 in the first direction DR1. The eleventh protrusion PP11 may be a portion protruding from a fourth inside surface SSD4 in the second direction DR2. In an embodiment of the disclosure, the eighth protrusion PP8 may include a third sub-protrusion PP8_*a* and a fourth sub-protrusion PP8_*b* spaced apart from each other in the first direction DR1. In an embodiment of the disclosure, the eleventh protrusion PP11 may include a fifth sub-protrusion PP11_*a* and a sixth sub-protrusion PP11_*b* spaced apart from each other in the first direction DR1.

The tenth support SP10 may be coupled with one portion (e.g., the eighth protrusion PP8) of the sidewall SW. The eleventh support SP11 may be coupled with one portion (e.g., the ninth protrusion PP9) of the sidewall SW. The twelfth support SP12 may be coupled with one portion (e.g., the tenth protrusion PP10) of the sidewall SW. The thirteenth support SP13 may be coupled with one portion (e.g., the eleventh protrusion PP11) of the sidewall SW. However, the disclosure is not limited thereto. In an alternative embodiment where the sidewall SW does not include the protrusions, the tenth to thirteenth supports SP10 to SP13 may be directly coupled to the inside surfaces of the sidewall SW.

In an embodiment of the disclosure, the tenth support SP10 may include a third sub-support SP10_*a* and a fourth sub-support SP10_*b*. The third sub-support SP10_*a* and the fourth sub-support SP10_*b* may be disposed to be spaced apart from each other in the first direction DR1. In an embodiment of the disclosure, the third sub-support SP10_*a* may be coupled with the third sub-protrusion PP8_*a* included in the sidewall SW. The fourth sub-support SP10_*b* may be coupled with the fourth sub-protrusion PP8_*b* included in the sidewall SW. In such an embodiment, the third sub-support SP10_*a* and the fourth sub-support SP10_*b* spaced apart from each other in the first direction DR1 guide the position of a display panel DP, such that an effect of preventing the display panel DP from being shifted in the second direction DR2 may be increased. In such an embodiment, an effect of preventing the display panel DP from being tilted in a direction crossing the second direction DR2 may be increased.

In an embodiment of the disclosure, the thirteenth support SP13 may include a fifth sub-support SP13_*a* and a sixth sub-support SP13_*b*. The fifth sub-support SP13_*a* and the sixth sub-support SP13_*b* may be disposed to be spaced apart from each other in the first direction DR1. In an embodiment of the disclosure, the fifth sub-support SP13_*a* may be coupled with the fifth sub-protrusion PP11_*a* included in the sidewall SW. The sixth sub-support SP13_*b* may be coupled with the sixth sub-protrusion PP11_*b* included in the sidewall SW. In such an embodiment, the fifth sub-support SP13_*a* and the sixth sub-support SP13_*b* spaced apart from each other in the first direction DR1 guide the position of the display panel DP, such that an effect of preventing the display panel DP from being shifted in the direction opposite to the second direction DR2 may be increased. In such an embodiment, an effect of preventing the display panel DP from being tilted in a direction crossing the second direction DR2 may be increased.

Each of the third, fourth, fifth, and sixth sub-supports SP10_*a*, SP10_*b*, SP13_*a*, and SP13_*b* may include a fourth support portion extending in the first direction DR1.

Each of the eleventh and twelfth supports SP11 and SP12 may include a third support portion extending in the second direction DR2.

When the display panel DP is accommodated in a panel packaging tray PPT_b, a first side surface DSD1 of the display panel DP faces the twelfth support SP12, and a second side surface DSD2 of the display panel DP faces the third and fourth sub-supports SP10_*a* and SP10_*b*. Furthermore, when the display panel DP is accommodated in the panel packaging tray PPT_b, a third side surface DSD3 of the display panel DP faces the eleventh support SP11, and a fourth side surface DSD4 of the display panel DP faces the fifth and sixth sub-supports SP13_*a* and SP13_*b*. In an embodiment of the disclosure, when the display panel DP accommodated in the panel packaging tray PPT_b is tilted, the tilted display panel DP may make contact with at least one support among the third to sixth sub-supports SP10_*a*, SP10_*b*, SP13_*a*, and SP13_*b* and the eleventh and twelfth supports SP11 and SP12.

Referring to FIG. 6C, in an embodiment of in a panel packaging tray PPT_c, a plurality of supports SP include fourteenth and fifteenth supports SP14 and SP15. Hereinafter, the same or like components in FIG. 6C as those the components described above with reference to FIGS. 2, 6A, and 6B will be assigned with the same or like reference numerals, and any repetitive detailed descriptions thereof will be omitted.

In an embodiment of the disclosure, a sidewall SW of a packaging case PC_c may include a first protrusion PP1 and a twelfth protrusion PP12. In such an embodiment, the twelfth protrusion PP12 may include a portion protruding from a third inside surface SSD3 in the direction opposite to the first direction DR1 and a portion protruding from a fourth inside surface SSD4 in the second direction DR2.

The fourteenth support SP14 may be coupled with one portion (e.g., the first protrusion PP1) of the sidewall SW. The fifteenth support SP15 may be coupled with one portion (e.g., the twelfth protrusion PP12) of the sidewall SW. However, the disclosure is not limited thereto. In an alternative embodiment where the sidewall SW does not include the protrusions, the fourteenth and fifteenth supports SP14 and SP15 may be directly coupled to the inside surfaces of the sidewall SW.

Each of the fourteenth and fifteenth supports SP14 and SP15 may include a fifth support portion extending in the first direction DR1 and a sixth support portion extending in the second direction DR2. In an embodiment of the disclosure, in the first direction DR1, the length of the fifth support portion is longer than the length of the first support portion illustrated in FIG. 6A. In an embodiment of the disclosure, in the second direction DR2, the length of the sixth support portion is longer than the length of the second support portion illustrated in FIG. 6A. Accordingly, a support effect of guiding the position of a display panel DP may not be decreased even when the number of supports is smaller than that in FIG. 6A.

When the display panel DP is accommodated in a panel packaging tray PPT_c, a first corner portion DCN1 of the display panel DP faces the fourteenth support SP14, and a third corner portion DCN3 of the display panel DP faces the fifteenth support SP15. In an embodiment of the disclosure, when the display panel DP accommodated in the panel packaging tray PPT_c is tilted, the tilted display panel DP may make contact with at least one of the fourteenth and fifteenth supports SP14 and SP15.

Figure 7:
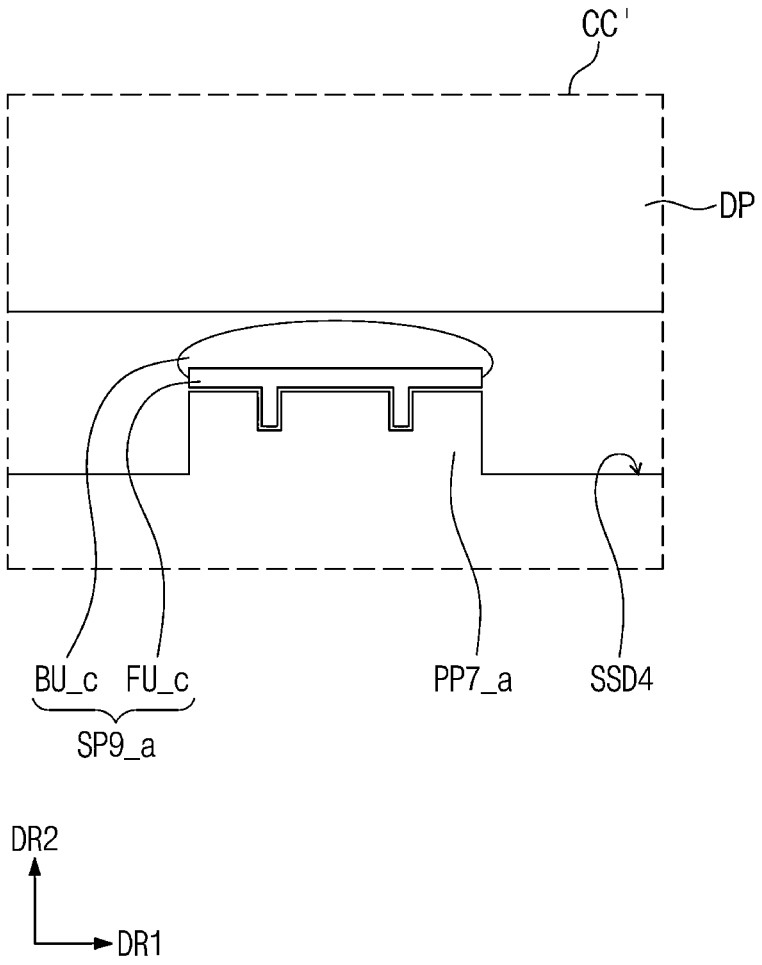
FIG. 7 is a view for describing the shape of a support according to an embodiment of the disclosure, where

FIG. 7 is a view for describing the shape of a support according to an embodiment of the disclosure, where FIG. 7 is an enlarged view of an area CC' illustrated in FIG. 6A.

Referring to FIGS. 6A and 7, one support (e.g., the first sub-support SP9_*a*) among the supports SP includes a third fixing unit FU_c and a third buffer unit BU_c. Some of the supports SP (e.g., the fifth and sixth supports SP5 and SP6) may have a structure similar to the structure of the first support SP1 illustrated in FIG. 3, and the other supports (e.g., the seventh and eighth supports SP7 and SP8 and the second sub-support SP9_*b*) may have a structure similar to the structure of the first sub-support SP9_*a*.

In an embodiment of the disclosure, a recess, to which the third fixing unit FU_c is coupled, is defined on the sidewall SW of the packaging case PC_a. The third fixing unit FU_c may be coupled with an inside surface of the sidewall SW of the packaging case PC_a. In an embodiment, the third fixing unit FU_c may be coupled with the first sub-protrusion PP7_*a* included in the sidewall SW. The third fixing unit FU_c may be press-fit into a recess formed on the first sub-protrusion PP7_*a*. In an embodiment of the disclosure, the third fixing unit FU_c may face the fourth inside surface SSD4 of the sidewall SW. In an embodiment of the disclosure, the third fixing unit FU_c may face the fourth inside surface SSD4 and may have a shape extending in the first direction DR1.

The third buffer unit BU_c is disposed between the third fixing unit FU_c and the display panel DP accommodated in the panel packaging tray PPT_a. In an embodiment of the disclosure, the third buffer unit BU_c may include curved portions CVP (refer to FIG. 4A) at opposite ends thereof in the first direction DR1. In such an embodiment, the curved portions CVP of the third buffer unit BU_c are formed to have a decreasing thickness from the central portion of the third buffer unit BU_c toward the opposite end portions of the third buffer unit BU_c based on the first direction DR1.

The display panel DP accommodated in the panel packaging tray PPT_a may make contact with the third buffer unit BU_c when tilted by an external impact. Specifically, the fourth side surface DSD4 of the display panel DP may make contact with the third buffer unit BU_c. The tilted display panel DP does not make contact with the third fixing unit FU_c because the third buffer unit BU_c is disposed between the display panel DP and the third fixing unit FU_c.

Figure 8:
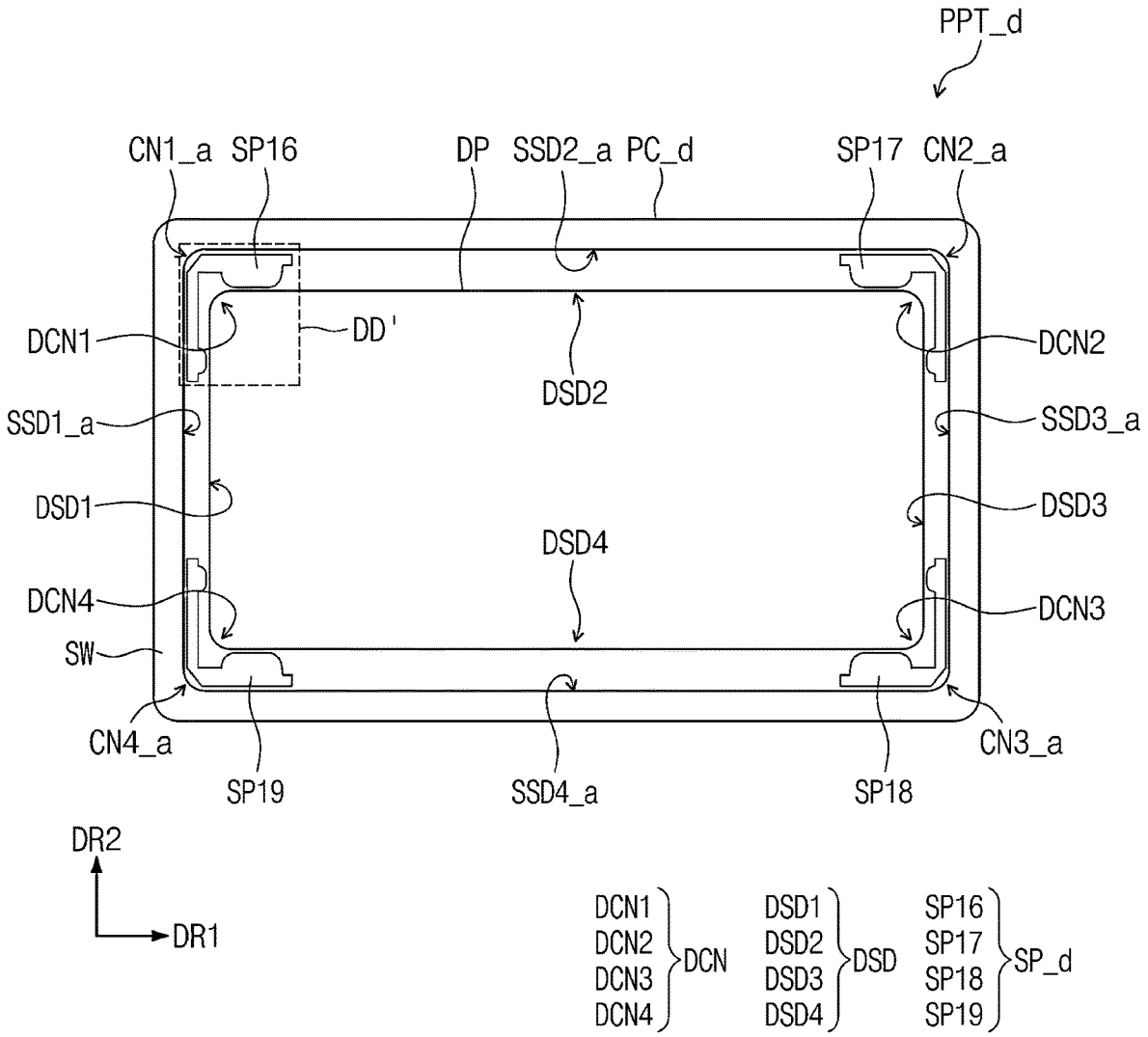
FIG. 8 is a plan view of a panel packaging tray according to an embodiment of the disclosure.

FIG. 8 is a plan view of a panel packaging tray according to an embodiment of the disclosure. Hereinafter, the same or like components in FIG. 8 as the components described above with reference to FIG. 2 will be assigned with the same or like reference numerals, and any repetitive detailed descriptions thereof will be omitted.

Referring to FIG. 8, a sidewall SW_a of a packaging case PC_d includes a first inside surface SSD1_*a* and a third inside surface SSD3_*a* that extend in the second direction DR2 and a second inside surface SSD2_*a* and a fourth side surface SSD4_*a* that extend in the first direction DR1. The packaging case PC_d has a first corner area CN1_*a* in which the first inside surface SSD1_*a* and the second inside surface SSD2_*a* meet each other, a second corner area CN2_*a* in which the second inside surface SSD2_*a* and the third inside surface SSD3_*a* meet each other, a third corner area CN3_*a* in which the third inside surface SSD3_*a* and the fourth inside surface SSD4_*a* meet each other, and a fourth corner area CN4_*a* in which the fourth inside surface SSD4_*a* and the first inside surface SSD1_*a* meet each other.

In an embodiment of the disclosure, a plurality of supports SP_d may include sixteenth to nineteenth supports SP16, SP17, SP18, and SP19. The sixteenth to nineteenth supports SP16 to SP19 may be coupled with the sidewall SW_a of the packaging case PC_d. In such an embodiment, the sixteenth support SP16 may be coupled with one portion of the sidewall SW_a in the first corner area CN1_*a*. The seventeenth support SP17 may be coupled with one portion of the sidewall SW_a in the second corner area CN2_*a*. The eighteenth support SP18 may be coupled with one portion of the sidewall SW_a in the third corner area CN3_*a*. The nineteenth support SP19 may be coupled with one portion of the sidewall SW_a in the fourth corner area CN4_*a*. However, the disclosure is not limited thereto. In an alternative embodiment where the sidewall SW_a further includes separate protrusions, the sixteenth to nineteenth supports SP16 to SP19 may be coupled to the protrusions of the sidewall SW_a, respectively.

In an embodiment of the disclosure, the sixteenth to nineteenth supports SP16 to SP19 may include or be formed of expanded polystyrene (EPS) or expanded polypropylene (EPP). The sixteenth to nineteenth supports SP16 to SP19 may have a higher hardness than the packaging case PC_d.

A display panel DP is accommodated in the panel packaging tray PPT_d in a way such that first to fourth corner portions DCN1 to DCN4 correspond to the sixteenth to nineteenth supports SP16 to SP19, respectively. The sixteenth to nineteenth supports SP16 to SP19 guide the position of the display panel DP on the plane, thereby preventing the display panel DP accommodated in the panel packaging tray PPT_d from being shifted in the first direction DR1 or the second direction DR2. Furthermore, the sixteenth to nineteenth supports SP16 to SP19 may prevent the display panel DP accommodated in the panel packaging tray PPT_d from being tilted in one of directions crossing the first and second directions DR1 and DR2.

In such an embodiment, as the display panel DP is accommodated in the panel packaging tray PPT_d in a way such that the first to fourth corner portions DCN1 to DCN4 of the display panel DP correspond to the sixteenth to nineteenth supports SP16 to SP19, respectively, empty spaces may be formed between the display panel DP accommodated in the panel packaging tray PPT_d and the sidewall SW_a of the packaging case PC_a. Accordingly, even when an impact is applied to the panel packaging tray PPT_d from the outside, the impact may be prevented from being transmitted to the display panel DP.

Figure 9:
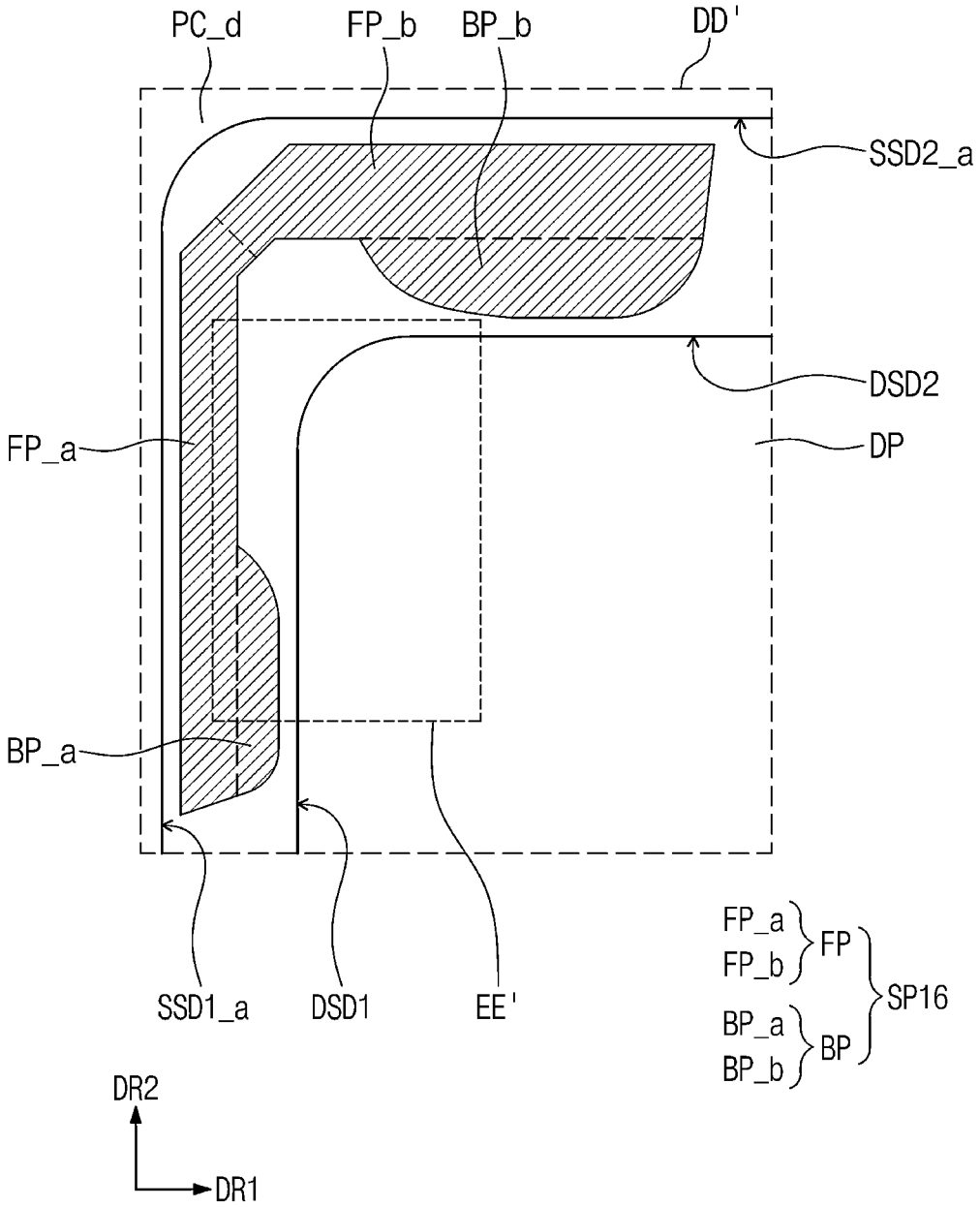
FIG. 9 is an enlarged view of an area DD' of the panel packaging tray illustrated in FIG. 8.

FIG. 9 is an enlarged view of an area DD' of the panel packaging tray illustrated in FIG. 8. Hereinafter, the same or like components in FIG. 9 as the components described above with reference to FIG. 8 will be assigned with the same or like reference numerals, and any repetitive detailed descriptions thereof will be omitted.

Referring to FIGS. 8 and 9, the sixteenth support SP16 is illustrated in FIG. 9. The seventeenth to nineteenth supports SP17 to SP19 have a structure similar to the structure of the sixteenth support SP16, and therefore descriptions of the seventeenth to nineteenth supports SP17 to SP19 will be omitted.

The sixteenth support SP16 includes a fixing portion FP and a buffer portion BP. In an embodiment of the disclosure, the fixing portion FP and the buffer portion BP may be integrally formed with each other as a single unitary and indivisible part. The fixing portion FP may be coupled with an inside surface of the sidewall SW_a of the packaging case PC_d. In an embodiment of the disclosure, the fixing portion FP includes a first fixing portion FP_a making contact with the first inside surface SSD1_*a* of the display panel DP and extending in the second direction DR2 and a second fixing portion FP_b making contact with the second inside surface SSD2_*a* and extending in the first direction DR1. The buffer portion BP may include a first buffer portion BP_a protruding from the first fixing portion FP_a in the first direction DR1 and a second buffer portion BP_b protruding from the second fixing portion FP_b in the direction opposite to the second direction DR2.

Figure 10:
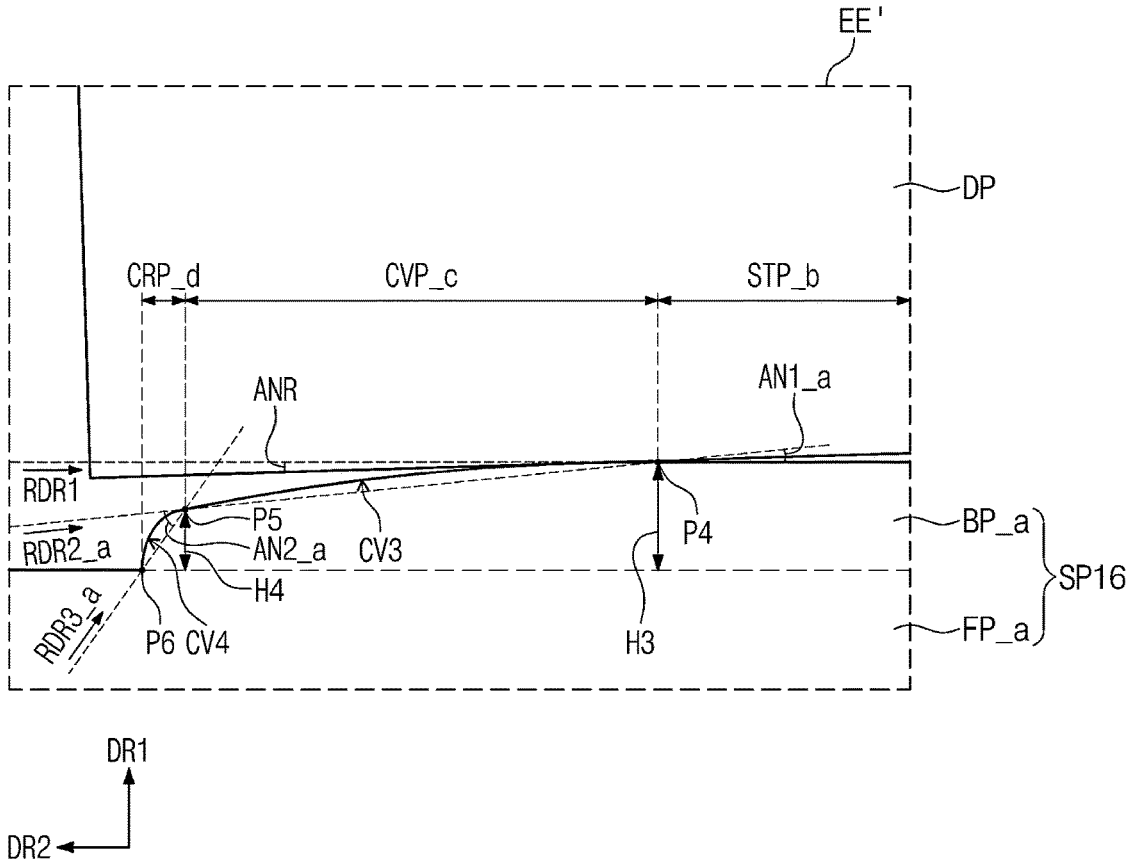
FIG. 10 is a view for describing a relationship between a maximum tilt angle and the shape of a support according to an embodiment of the disclosure, where

In an embodiment of the disclosure, each of the first buffer portion BP_a and the second buffer portion BP_b includes a curved portion CVP_a (refer to FIG. 10). The curved portions CVP_a of the first and second buffer portions BP_a and BP_b are formed to have a third curved surface CV3 (refer to FIG. 10) with a third curvature toward the portions with which the first fixing portion FP_a and the second fixing portion FP_b make contact.

The display panel DP accommodated in the panel packaging tray PPT_d may make contact with the buffer portion BP. In an embodiment, when the display panel DP accommodated in the panel packaging tray PPT_d is tilted by an external impact, the tilted display panel DP may make contact with the buffer portion BP. The tilted display panel DP does not make contact with the fixing portion FP because the buffer portion BP is located between the display panel DP and the fixing portion FP.

FIG. 10 is a view for describing a relationship between a maximum tilt angle and the shape of a support according to an embodiment of the disclosure, where FIG. 10 is an enlarged view of an area EE' illustrated in FIG. 9.

Referring to FIGS. 9 and 10, the first fixing portion FP_a and the first buffer portion BP_a of the sixteenth support SP16 are illustrated in FIG. 10. The second fixing portion FP_b of the sixteenth support SP16 has a structure similar to the structure of the first fixing portion FP_a, and the second buffer portion BP_b has a structure similar to the structure of the second buffer portion BP_b. Therefore, descriptions of the second fixing portion FP_b and the second buffer portion BP_b will be omitted.

The first buffer portion BP_a includes a straight portion STP_b, a corner portion CRP_d, and a curved portion CVP_c located between the straight portion STP_b and the corner portion CRP_d.

In an embodiment of the disclosure, the point at which the straight portion STP_b and the curved portion CVP_c meet each other may be referred to as a fourth point P4, the point at which the curved portion CVP_c and the corner portion CRP_d meet each other may be referred to as a fifth point P5, and the point at which the corner portion CRP_d and the first fixing portion FP_a meet each other may be referred to as a sixth point P6. In an embodiment of the disclosure, a direction parallel to the straight portion STP_b may be referred to as a first reference direction RDR1, and a direction parallel to a straight line passing through the fourth point P4 and the fifth point P5 may be referred to as a fourth reference direction RDR2_*a*. The length of the first buffer portion BP_a in the first direction DR1 at the fourth point P4 is referred to as the third length H3. The length of the first buffer portion BP_a in the first direction DR1 at the fifth point P5 is referred to as the fourth length H4. In such an embodiment, the third length H3 is longer than the fourth length H4. Accordingly, the first reference direction RDR1 and the fourth reference direction RDR2_*a* cross each other. In an embodiment of the disclosure, an acute angle between the first reference direction RDR1 and the fourth reference direction RDR2_*a* is referred to as a third angle AN1_*a*.

In an embodiment of the disclosure, the curved portion CVP_c is formed to have a curved surface CV3 (hereinafter, referred to as the third curved surface) with a third curvature based on the second direction DR2. The corner portion CRP_d is formed to have a curved surface CV4 (hereinafter, referred to as the fourth curved surface) with a fourth curvature based on the second direction DR2. In the remaining area, the first buffer portion BP_a may have the straight portion STP_b that does not have a curvature and is parallel to the first reference direction RDR1.

In an embodiment of the disclosure, the third angle AN1_*a* is greater than or equal to the maximum tilt angle ANR_a. In an embodiment, the first buffer portion BP_a includes the curved portion CVP_c to allow the third angle AN1_*a* to be greater than or equal to the maximum tilt angle ANR_a. The third curvature of the curved portion CVP_c is determined by the maximum tilt angle ANR_a. In such an embodiment, the third curvature may be determined by the length of the curved portion CVP_c in the second direction DR2 and the maximum tilt angle ANR_a.

In an embodiment of the disclosure, a direction parallel to a straight line passing through the fifth point P5 and the sixth point P6 may be referred to as a fifth reference direction RDR3_*a*. In an embodiment of the disclosure, the corner portion CRP_d has the fourth curved surface CV4 with the fourth curvature different from the third curvature and is formed to make contact with the first fixing portion FP_a. Accordingly, the fourth reference direction RDR2_*a* and the fifth reference direction RDR3_*a* cross each other. In an embodiment of the disclosure, an acute angle between the fourth reference direction RDR2_*a* and the fifth reference direction RDR3_*a* is referred to as a fourth angle AN2_*a*.

In an embodiment of the disclosure, the length of the corner portion CRP_d in the second direction DR2 is shorter than the length of the curved portion CVP_c in the second direction DR2, and the fourth curvature of the fourth curved surface CV4 is greater than the third curvature of the third curved surface CV3. Accordingly, the third angle AN1_*a* is smaller than the fourth angle AN2_*a*.

Figure 11:
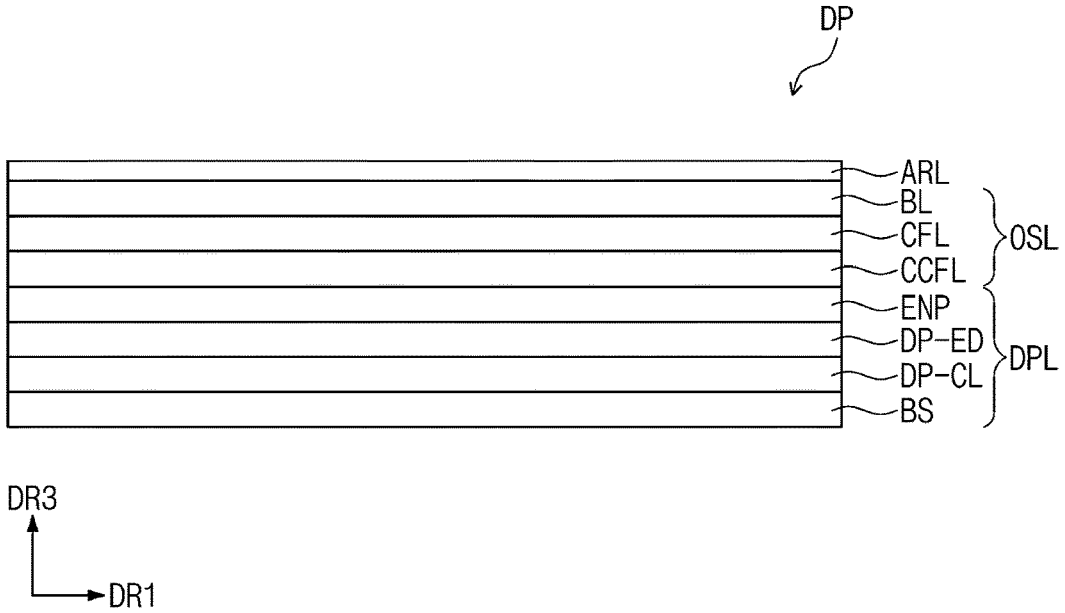
FIG. 11 is a sectional view of a display panel according to an embodiment of the disclosure.
Figure 12:
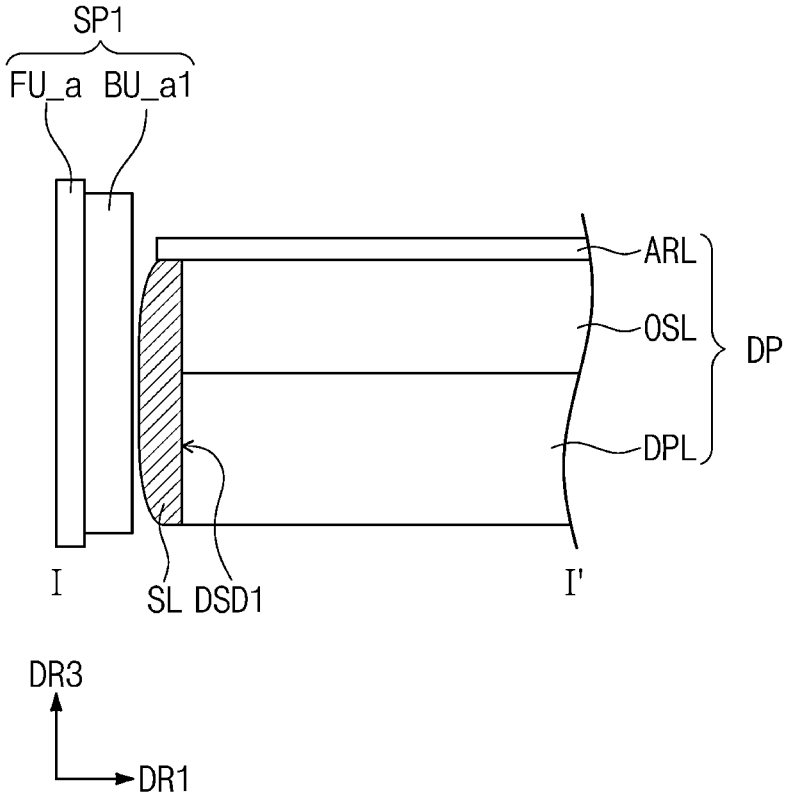
FIG. 12 is a view for describing a relationship between a support and the display panel according to an embodiment of the disclosure, where

FIG. 11 is a sectional view of a display panel according to an embodiment of the disclosure. FIG. 12 is a view for describing a relationship between a support and the display panel according to an embodiment of the disclosure, where FIG. 12 is a sectional view taken along line I-I' illustrated in FIG. 3. Hereinafter, the same or like components in FIGS. 11 and 12 as the components described above with reference to FIGS. 2, 4A, and 4B will be assigned with the same or like reference numerals, and any repetitive detailed descriptions thereof will be omitted.

Referring to FIG. 11, in an embodiment, the display panel DP accommodated in the panel packaging tray PPT (refer to FIG. 1) may be an emissive display panel. The display panel DP may be one of an inorganic light emitting display panel, a quantum dot light emitting display panel, or an organic light emitting display panel and is not particularly limited. A light emitting element of the organic light emitting display panel may contain an organic light emitting material. A light emitting element of the inorganic light emitting display panel may contain an inorganic light emitting material. A light emitting element of the quantum dot light emitting display panel may contain quantum dots and quantum rods.

The display panel DP includes a light generating layer DPL and a light control layer OSL.

In an embodiment of the disclosure, the light generating layer DPL includes a base substrate BS, a circuit element layer DP-CL disposed on the base substrate BS, a display element layer DP_ED, and an encapsulation layer ENP.

The base substrate BS may include a glass substrate, a metal substrate, or an organic/inorganic composite substrate. The circuit element layer DP-CL includes a drive circuit including transistors for controlling a plurality of pixels included in the display panel DP or signal lines. The display element layer DP-ED includes light emitting elements disposed in the respective pixels. The encapsulation layer ENP includes at least one inorganic layer that seals the light emitting elements.

The light control layer OSL may include a light control pattern layer CCFL, a color filter layer CFL, a base layer BL, and an anti-reflection layer ARL. The light control pattern layer CCFL may change optical properties of light generated from the light generating layer DPL. In an embodiment of the disclosure, where light generated from the light emitting elements included in the display element layer DP_ED is blue light, the light control pattern layer CCFL may include a first color change pattern that changes the blue light into red light, a second color change pattern that changes the blue light into green light, and a transmission pattern that does not change the wavelength of the blue light.

The color filter layer CFL transmits light in a specific wavelength range and blocks light outside the corresponding wavelength range. In an embodiment of the disclosure, the color filter layer CFL may include a first color filter that transmits red light and blocks green light and blue light, a second color filter that transmits green light and blocks red light and blue light, and a third color filter that transmits blue light and blocks red light and green light.

The base layer BL may be a member that provides a base surface on which the color filter layer CFL and the light control pattern layer CCFL are disposed. The base layer BL may be a glass substrate, a metal substrate, or a plastic substrate. However, embodiments are not limited thereto, and the base layer BL may be an inorganic layer, an organic layer, or a composite layer. Alternatively, the base layer BL may be omitted.

The anti-reflection layer ARL may be a layer that decreases the reflectivity of external light incident from the outside. In an embodiment of the disclosure, the anti-reflection layer ARL may be a single layer that includes a dye and/or a pigment dispersed in a base resin. In an embodiment, the anti-reflection layer ARL may be a thin film.

In an embodiment of the disclosure, the display panel DP may further include a filling layer (not shown) disposed between the light generating layer DPL and the light control layer OSL. The filling layer may fill the space between the light generating layer DPL and the light control layer OSL. The filling layer may function as a buffer between the light generating layer DPL and the light control layer OSL.

Referring to FIGS. 2, 4B, 11, and 12, the display panel DP further includes a buffer member SL disposed on a first side surface DSD1 of the display panel DP. Although only the buffer member SL disposed on the first side surface DSD1 of the display panel DP is illustrated in FIG. 12, the buffer member SL may be disposed on at least two side surfaces of the display panel DP. In an embodiment of the disclosure, the buffer member SL may be disposed on the first side surface DSD1, the third side surface DSD3, and the fourth side surface DSD4 of the display panel DP. In an embodiment of the disclosure, the buffer member SL may be disposed on the first to fourth side surfaces DSD1 to DSD4 of the display panel DP. In an embodiment of the disclosure, the buffer member SL may alleviate an impact applied to the first to fourth side surfaces DSD1 to DSD4 of the display panel DP from the outside, thereby performing a function of preventing damage to the display panel DP.

In an embodiment of the disclosure, on the plane, the anti-reflection layer ARL may have a larger area than the display panel DP. In such an embodiment, the anti-reflection layer ARL and the buffer member SL may overlap each other in the third direction DR3.

When the display panel DP accommodated in the panel packaging tray PPT is tilted, the buffer member SL of the display panel DP, on the plane, makes contact with the first sub-buffer unit BU_a1 included in the first support SP1. In an embodiment of the disclosure, the buffer member SL has a lower hardness than the first sub-buffer unit BU_a1. Accordingly, if the load of the tilted display panel DP is concentrated on a specific area of the first sub-buffer unit BU_a1, the buffer member SL corresponding to the corresponding area is pressed in the first direction DR1. The volume of the buffer member SL is increased in the third direction DR3 or the direction opposite to the third direction DR3 by the volume of the buffer member SL pressed in the first direction DR1. If the volume of the buffer member SL is increased in the third direction DR3, the anti-reflection layer ARL overlapping the buffer member SL in the third direction DR3 may be peeled from the light control layer OSL in the third direction DR3, and therefore the display quality of the display panel DP may be deteriorated.

In an embodiment of the disclosure, the first sub-buffer unit BU_a1 includes the curved portion CVP, and thus the load of the tilted display panel DP is distributed over the curved portion CVP of the first sub-buffer unit BU_a1. In such an embodiment, the buffer member SL is pressed in the first direction DR1 and the second direction DR2. Accordingly, as compared with a case where the buffer member SL is pressed only in the first direction DR1, the volume of the buffer member SL increased in the third direction DR3 or the direction opposite to the third direction DR3 is decreased. Thus, a defect that may occur when the anti-reflection layer ARL overlapping the buffer member SL in the third direction DR3 is peeled from the light control layer OSL in the third direction DR3 may be effectively prevented, such that the display quality of the display panel DP is improved.

According to embodiments of the disclosure, the panel packaging tray guides the position of the display panel, thereby preventing the display panel from being damaged by an impact transmitted to the packaging tray from the outside. In such embodiments, the panel packaging tray of the disclosure includes the plurality of supports that guide the position of the display panel. In such embodiments, each of the supports includes the curved portion, and thus the load of the display panel is not concentrated on an edge portion of the support even when the display panel accommodated in the panel packaging tray is tilted. Accordingly, in such embodiments, damage to the display panel may be effectively prevented.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A panel packaging tray comprising:

a packaging case including a sidewall which defines a receiving section in which a display panel is allowed to be accommodated; and a plurality of supports disposed on an inside surface of the sidewall, wherein the supports guide a position of the display panel on a plane defined to cross the inside surface, wherein a supporter of the supports includes:

a fixing unit coupled with the sidewall; and a buffer unit disposed between the fixing unit and the display panel, wherein the buffer unit includes a straight portion, a corner portion, and a curved portion located between the straight portion and the corner portion, based on a direction parallel to the plane, wherein the buffer unit includes a first point at which the straight portion and the curved portion meet each other, a second point at which the curved portion and the corner portion meet each other, and a third point at which the corner portion and the fixing unit meet each other, wherein the curve portion includes a curved surface convexly curved with respect to a straight line defined to pass through the first point and the second point, and wherein a curvature of the curved surface included in the curved portion is determined by a maximum tilt angle by which the display panel is allowed to be tilted in a state of being accommodated in the receiving section.

2. The panel packaging tray of claim 1, wherein a direction parallel to the straight portion is referred to as a first reference direction, and a direction parallel to the straight line defined to pass through the first point and the second point is referred to as a second reference direction, and wherein the first reference direction and the second reference direction cross each other, and an acute angle between the first reference direction and the second reference direction is a first angle.

3. The panel packaging tray of claim 2, wherein the display panel includes a plurality of side surfaces, wherein a side surface when the display panel makes contact with the curved portion in the state of being accommodated in the receiving section, among the plurality of side surfaces, is referred to as an adjacent surface, wherein an acute angle between the first reference direction and a direction parallel to the adjacent surface are referred to as a tilt angle, and wherein the maximum tilt angle is the largest value of the tilt angle.

4. The panel packaging tray of claim 3, wherein the first angle is greater than or equal to the maximum tilt angle.

5. The panel packaging tray of claim 4, wherein the first angle is smaller than twice the maximum tilt angle.

6. The panel packaging tray of claim 2, wherein when a direction parallel to a straight line defined to pass through the second point and the third point is referred to as a third reference direction, the first angle differs from a second angle which is an acute angle between the second reference direction and the third reference direction.

7. The panel packaging tray of claim 6, wherein the first angle is smaller than the second angle.

8. The panel packaging tray of claim 1, wherein the curved portion includes a first curved surface having a first curvature based on the plane, and the corner portion includes a second curved surface having a second curvature based on the plane, and wherein the first curvature and the second curvature differ from each other.

9. The panel packaging tray of claim 8, wherein the first curvature is smaller than the second curvature.

10. The panel packaging tray of claim 1, wherein a plurality of grooves is defined on the curved portion.

11. The panel packaging tray of claim 1, wherein the sidewall includes a first corner area in which a first inside surface and a second inside surface meet each other, a second corner area in which the second inside surface and a third inside surface meet each other, a third corner area in which the third inside surface and a fourth inside surface meet each other, and a fourth corner area in which the first inside surface and the fourth inside surface meet each other.

12. The panel packaging tray of claim 11, wherein the supports include, on the plane, a first support which makes contact with the first corner area, a second support which makes contact with the second corner area, a third support which makes contact with the third corner area, and a fourth support which makes contact with the fourth corner area.

13. The panel packaging tray of claim 11, wherein the supports include, on the plane, a first support which makes contact with the first corner area, a second support which makes contact with the second corner area, a third support which makes contact with the first inside surface, a fourth support which makes contact with the third inside surface, and a fifth support which makes contact with the fourth inside surface.

14. The panel packaging tray of claim 13, wherein the fifth support includes a plurality of sub-supports spaced apart from each other on the plane.

15. The panel packaging tray of claim 11, wherein the supports include, on the plane, a first support which makes contact with the first inside surface, a second support which makes contact with the second inside surface, a third support which makes contact with the third inside surface, and a fourth support which makes contact with the fourth inside surface.

16. The panel packaging tray of claim 11, wherein the supports include, on the plane, a first support which makes contact with the first corner area and a second support which makes contact with the third corner area.

17. A panel packaging tray comprising:

a packaging case including a sidewall which defines a receiving section in which a display panel is allowed to be accommodated; and a plurality of supports disposed on an inside surface of the sidewall, wherein the supporters guide a position of the display panel on a plane defined to cross the inside surface, wherein a supporter of the supports includes:

a fixing portion coupled with the sidewall; and a buffer portion protruding from the fixing portion on the plane, wherein the buffer portion includes a straight portion, a corner portion, and a curved portion located between the straight portion and the corner portion, based on a direction parallel to the plane, wherein each of the supports includes a first point at which the straight portion and the curved portion meet each other, a second point at which the curved portion and the corner portion meet each other, and a third point at which the corner portion and the packaging case meet each other, wherein the curved portion includes a curved surface convexly protruded with respect to a straight line defined to pass through the first point and the second point, and wherein a curvature of the curved surface included in the curved portion is determined by a maximum tilt angle by which the display panel is allowed to be tilted in a state of being accommodated in the receiving section.

18. The panel packaging tray of claim 17, wherein a direction parallel to the straight portion is referred to as a first reference direction, and a direction parallel to the straight line defined to pass through the first point and the second point is referred to as a second reference direction, and wherein the first reference direction and the second reference direction cross each other, and an acute angle between the first reference direction and the second reference direction is a first angle.

19. The panel packaging tray of claim 18, wherein the display panel includes a plurality of side surfaces, wherein a side surface when the display panel makes contact with the curved portion in the state of being accommodated in the receiving section, among the plurality of side surfaces, is referred to as an adjacent surface, wherein an acute angle between the first reference direction and a direction parallel to the adjacent surface are referred to as a tilt angle, and wherein the maximum tilt angle is the largest value of the tilt angle.

20. The panel packaging tray of claim 19, wherein the first angle is greater than or equal to the maximum tilt angle.

21. The panel packaging tray of claim 20, wherein the first angle is smaller than twice the maximum tilt angle.

22. The panel packaging tray of claim 18, wherein when a direction parallel to a straight line defined to pass through the second point and the third point is referred to as a third reference direction, the first angle differs from a second angle which is an acute angle between the second reference direction and the third reference direction.

23. The panel packaging tray of claim 22, wherein the first angle is smaller than the second angle.

* * * * *